United States Patent [19]

Sugiyama et al.

[11] 4,059,448

[45] Nov. 22, 1977

[54] DYE CONTAINING PHOTOGRAPHIC SENSITIVE ELEMENTS

[75] Inventors: Masatoshi Sugiyama; Eiichi Kato; Yasuharu Nakamura, all of Minami-ashigara, Japan

[73] Assignee: Fuji Photo Film Co., Ltd., Minami-ashigara, Japan

[21] Appl. No.: 613,013

[22] Filed: Sept. 12, 1975

[30] Foreign Application Priority Data

Sept. 12, 1974 Japan ..... 49-105289

[51] Int. Cl.[2] ..... G03C 1/84

[52] U.S. Cl. ..... 96/84 A; 96/57

[58] Field of Search ..... 96/84 R, 84 A, 84 UV, 96/84 M, 57

[56] References Cited

U.S. PATENT DOCUMENTS

| | | | |
|---|---|---|---|
| 3,445,231 | 5/1969 | Nishio et al. | 96/84 A |
| 3,624,229 | 11/1971 | Timmerman et al. | 96/57 |
| 3,726,683 | 4/1973 | Yammamoto et al. | 96/84 A |
| 3,740,228 | 6/1973 | Ohleschlager et al. | 96/84 A |
| 3,746,547 | 7/1973 | Tsuji et al. | 96/84 A |
| 3,795,519 | 3/1974 | Miyazako et al. | 96/84 A |
| 3,865,817 | 1/1975 | Kabayashi et al. | 96/84 R |
| 3,876,429 | 4/1975 | Poppe et al. | 96/84 A |

*Primary Examiner*—Jack P. Brammer

*Attorney, Agent, or Firm*—Sughrue, Rothwell, Mion, Zinn and Macpeak

[57] ABSTRACT

A silver halide photographic light-sensitive element containing at least one hydrophilic colloid layer which contains a basic polymer and at least one oxonol dye which contains two pyrazolone nuclei in which the 3-position of the pyrazolone nuclei is substituted with a phenyl group-containing residue and in which the 1-position of the pyrazolone nuclei is substituted with a sulfo group containing aliphatic group.

11 Claims, 1 Drawing Figure

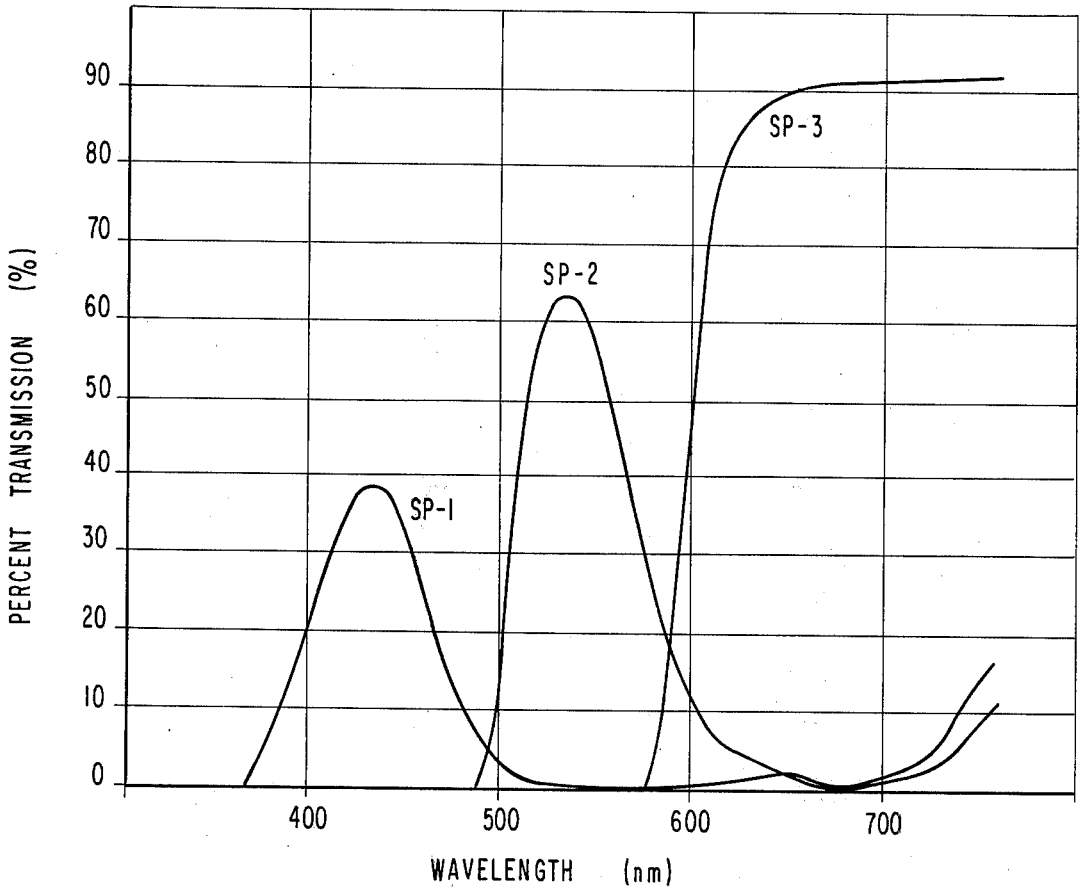
PERCENT TRANSMISSION (%)
90
80
70
60
50
40
30
20
10
0
SP-1
SP-2
SP-3
400
500
600
700
WAVELENGTH (nm)

DYE CONTAINING PHOTOGRAPHIC SENSITIVE ELEMENTS

BACKGROUND OF THE INVENTION

1. Field of the Invention

The present invention relates to photographic light-sensitive elements having a dyed hydrophilic colloid layer. Particularly, the present invention relates to silver halide photographic light-sensitive elements having a hydrophilic colloid layer containing a dye which is easily decolored and removed at photographic processings and a basic polymer.

2. Description of the Prior Art

In silver halide photographic light-sensitive elements, a photographic emulsion layer or another layer is often dyed for the purpose of absorbing light in a specific wavelength range.

When control of the spectral composition of light incident upon a photographic emulsion layer is required, a colored layer is provided in a position farther from the support than the photographic emulsion layers in the photographic light-sensitive element. Such a colored layer is called a filter layer. Where a plurality of photographic emulsion layers is present, such as in a multilayer color photosensitive material, the filter layer sometimes as positioned between the photographic emulsion layers.

For the purpose of preventing the images from becoming indistinct, namely, halation caused by scattering of light rays passing through the photographic emulsion layers or after passage through and upon reflection at the interface between the emulsion layer and the support or the opposite surface of the photosensitive material and reentry into the photographic emulsion layers, a colored layer is positioned between the photographic emulsion layer and the support or on the opposite side of the support. Such a layer is called an antihalation layer. Where a plurality of photographic emulsion layers is present such as in a multilayer color photosensitive material, such a layer sometimes is positioned between the photographic emulsion layers.

For the purpose of preventing a reduction in image sharpness caused by scattering of light in the photographic emulsion layers (this phenomenon is called, in general, irradiation), the photographic emulsion layers are sometimes colored.

These layers which are colored often comprise hydrophilic colloids. Therefore, water soluble dyes are usually incorporated in the layers for coloration. Dyes used for such a purpose should have, of course, appropriate spectral absorption characteristics depending on the purpose of use and should satisfy the following requirements.

1. The dyes should be photochemically inert. Namely, the dyes should not have an adverse chemical influence upon the properties of the silver halide photographic emulsion layers, such as reduce the sensitivity, decay the latent images or generate fog.
2. The dyes should be decolored or removed by dissolution during the photographic processings or not leave an undesired coloration on the photographic sensitive material after processing.

Many attempts have been made to discover dyes which satisfy these requirements. For example, oxonol dyes having a pyrazolone nucleus described in British Pat. No. 506,385, Japanese patent publications Nos. 22069/1964 and 13168/1968 and Japanese patent application (OPI) No. A 85130/1973, oxonol dyes having a barbituric acid nucleus described in U.S. Pat. Nos. 3,247,127 and 3,653,905, oxonol dyes described in French Pat. No. 1,401,588, benzylidene (or cinnamylidene) pyrazolone dyes described in British Pat. No. 584,609, U.S. Pat. Nos. 3,540,887, 3,615,546 and 3,687,670 and French Pat. Nos. 1,350,311 and 1,421,679, styryl dyes described in U.S. Pat. Nos. 2,298,733, 2,622,082, 3,384,487 and 3,652,283, British Pat. Nos. 1,075, 653 and Belgian Pat. No. 733,124, merocyanine dyes described in British Pat. No. 1,075,653 (those having formula IV), British Pat. Nos. 1,153,341 and 1,284,730 and French Pat. No. 1,401,588 (those having formula II) and cyanine dyes described in U.S. Pat. Nos. 2,843,486 and 3,294,539 and British Pat. No. 1,075,653 (with the exception of those having formulae I and II).

Many dyes which are decolored in photographic processing are decolored by sulfites (or bisulfites) present in the development processing solution or by sulfites and alkaline conditions (for example, as described in British Pat. No. 506,385).

In prior photographic processings, both dyes which are decolored by development processing as described above and dyes which are easily removed by dissolution from the photosensitive material without decoloring or with imperfect decoloring have been used as dyes for coloring the hydrophilic collid layer of photosensitive materials. The latter dyes not only color the photographic processing solutions or the water used for washing to cause environmental pollution, but also are not suitable for rapid photographic processing in which the processing time is shortened to be efficient, which has been employed recently. The dyes used for the photosensitive materials for such use should be not only decolor completely and rapidly during photographic processing such as development, but also they must have properties whereby the decolored dyes are easily removed from the photosensitive material during the subsequent processings and mainly during a washing step by water and do not form a color again in the photosensitive element or in the processing solutions or water for washing during the processing. Most hitherto known dyes are unsatisfactory for rapid photographic processing from the standpoints of decoloring rate at development, dissolution rate of the decolored or non-decolored dyes and irreversibility of the decoloring.

On the other hand, where the colored layer is a filter layer or is an antihalation layer positioned on the same side of the support as the photographic emulsion layer, commonly the selective coloration of such a layer without the other layers being substantially colored is required. This is because the dye causes not only a deterioration of the effect of the filter layer or of the anitihalation layer but also the dye adversely spectrally influences the other layers.

There are several processes for selectively coloring a specific hydrophilic colloid layer. However, the process which comprises incorporating a hydrophilic polymer containing a portion having a charge opposite to that of the dye ions together with a mordanting agent in the hydrophilic colloid layer, by which thedye is only present in the specific layer due to an interaction of the polymer and the dye molecule (it is believed that not only a charge attraction exists but also that a hydrophobic bond contributes to the attraction involved), is most widely used. Polymers derived from ethylenically unsaturated compounds having a dialkylaminoalkyl ester residue described in British Pat. No. 685,475, reaction products prepared by reacting polyvinyl alkylketones with aminoguanidine described in British Pat. No. 850,281 and polymers derived from 2-methyl-1-vinylimidazole described in U.S. Pat. No. 3,445,231 are used as mordanting agents. In using a mordanting process with such polymers, a portion of the dye in the dye containing layer often diffuses into other hydrophilic colloid layers when the dye containing layer contacts the hydrophilic colloid layers in a wet condition. The diffusion of the dye also depends, of course, upon the chemical structure of the mordanting agent and the chemical structure of the dye used.

Further, in using the above described high molecular weight mordanting agents, residual color is easily formed on the photosensitive material after photographic processing and particularly after a rapid processing in which the processing time is shortened. This is believed to be because although the bonding strength of the mordanting agent to the dye becomes fairly low in an alkaline solution such as a developer, some degree of bonding strength remains and the dye or reversibly decolored products remain in the mordanting agent containing layer. Although such a difficulty depends upon the chemical structure of the mordanting agent, it greatly depends upon the chemical structure of the dye.

On the other hand, a residual color is easily formed in the photosensitive elements after processing where an emulsified dispersion of a hydrophobic organic solvent, such as an aliphatic acid ester, an aromatic carvoxylic acid ester, a phosphoric acid aryl ester or an aromatic ether, etc., is included in any of hydrophilic colloid layers of the photosensitive element for the purpose of incorporating couplers or color stain preventing agents, etc. This is believed to be due to the fact that when the dye is included in a layer containing such an emulsified dispersion, or the dye diffuses from other layers into this layer, a portion of the dye incorporates into the interior of or at the surface of the emulsified dispersion particles, and the dye remains without being removed in a washing step with water.

Of the various water soluble dyes used for dyeing the hydrophilic colloid layers of photographic light-sensitive elements, oxonol dyes having a pyrazolone nucleus represented by the dyes described in British Pat. No. 506,385 are useful dyes, because these dyes are irreversibly decolored in developers containing sulfite and do not adversely influence the photographic properties of the photographic emulsions. However, these oxonol dyes are not sufficiently mordanted by the above described basic polymers and diffuse from the basic polymer containing layer to other layers.

On the other hand, where the colored layer is the filter layer, an absorption density above about 0.8 is necessary and often such a density must be obtained with a layer having a thickness of about 2 $\mu$m or less. For example, a typical case is a yellow filter layer which is positioned below (closer to the support) a colored photosensitive layer of a multilayer color photosensitive element. In such a case, the dye must not only dissolve in the hydrophilic colloid in a high concentration but also should be mordanted surficiently by the basic polymers.

SUMMARY OF THE INVENTION

A first object of the present invention is to provide silver halide photographic light-sensitive elements having a hydrophilic colloid layer colored with a water soluble dye which is irreversibly decolored during photographic processings and which does not adversely influence the photographic properties of photographic emulsions.

A second object of the present invention is to provide silver halide photographic light-sensitive elements having hydrophilic colloid layers wherein only a basic polymer containing hydrophilic colloid layer is sufficiently dyed selectively by the dye.

A third object of the present invention is to provide silver halide photographic light-sensitive elements having a hydrophilic colloid layer containing a dye which does not give rise to residual color after photographic processings even if basic polymers are present in any of the hydrophilic colloid layers comprising the photosensitive material.

These objects of the present invention have been attained by a silver halide photosensitive element wherein a basic polymer is included in at least one hydrophilic colloid layer and an oxonol dye having a pyrazolone nucleus in which the 3-position of the nucleus is substituted with a phenyl group-containing residue and in which the 1-position of the nucleus is substituted with a sulfo group-containing aliphatic group is present in at least one hydrophilic colloid layer.

BRIEF DESCRIPTION OF THE DRAWING

The FIGURE shows the spectral transmittance curves of Fuji separation Filters SP-1, SP-2 and SP-3, produced by the Fuji Photo Film Co., Ltd. used in Examples 2, 3 and 4.

DETAILED DESCRIPTION OF THE INVENTION

The dyes used in the present invention can be represented by the following formula (I)

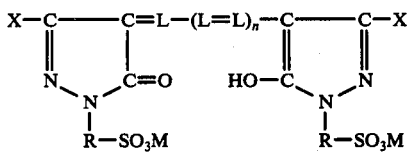

(I)

In formula (I), R represents a divalent aliphatic group having 5 or less carbon atoms, wherein the carbon chain can contain an unsaturated bond or can be interrupted by a hetero atom such as oxygen or sulfur, etc. The above described aliphatic group can be substituted with various substituents. For example, suitable substituents include a hydroxy group, an alkoxy group having 3 or less carbon atoms (for example , a methoxy group or ethoxy group) or a halogen atom (for example, a chlorine atom). Specific examples of the above described divalent aliphatic group include alkylene groups, for example, an ethylene group, a propylene group, a 2-methylethylene group, a butylene group, a 3-methylpropylene group and a 1-methylbutylene group, etc.; alkenylene groups, for example, a vinylene group, a propenylene group ($—CH_2—CH=CH—$); alkyleneoxyalkylene groups, for example, propyleneoxyethylene groups (namely, a 3-oxahexane(1,6)diyl group); alkylenethioalkylene groups, for example, a propylenethioethylene group; and substituted alkylene groups, for example, a 2-hydroxy-1,3-propylene group, a 3-hydroxy-1,4-butylene group, a 3-methoxypentylene group, etc.

M represents a cation such as a hydrogen atom, an alkali metal atom (for example, sodium or potassium), an alkaline earth metal atom (for example, calcium), an ammonium group or an organic base (for example, triethylamine, pyridine, piperidine or morpholine), etc.

X represents $—X^1$, $—CH_2X^1$, $—CONHX^1$, $—NHCONHX^1$ or $—NHCSNHX^1$, wherein $X^1$ represents a phenyl group. The phenyl group can be substituted. Examples of suitable substituents include halogen atoms (for example, chlorine or bromine, etc.), a cyano group, a sulfo group, a carboxy group, an alkoxycarbonyl group having 1 to 5 carbon atoms in the alkoxy moiety (for example, an ethoxycarbonyl group and a butoxycarbonyl group), a carbamoyl group, an alkylcarbamoyl group having 1 to 5 carbon atoms in the alkyl moiety, for example, methylcarbamoyl, ethylcarbamoyl, butylcarbamoyl, etc., an acyl group having 2 to 6 carbon atoms, for example acetyl, prop onyl, methanesulfonyl, etc., an alkyl group having 1 to 8 carbon atoms, for example, methyl, ethyl, i-propyl, n-butyl, n-octyl, etc., a hydroxy group, an alkoxy group having 1 to 6 carbon atoms, for example, methoxy, ethoxy, butoxy, etc., a phenoxy group, an amino group, an alkylamino group having 1 to 5 carbon atoms in the alkyl moiety (for example, an ethylamino group and a butylamino group), a dialkylamino group having 1 to 3 carbon atoms in the alkyl moieties (for example, a dimethylamino group and a diethylamino group), acylamino groups having an alkyl moiety of 1 to 5 carbon atoms (for example, an acetamido group and a valeramido group), a alkylsulfonylamino group having 1 to 5 carbon atoms in the alkyl moiety (for example, methylsulfonylamino group), and an alkylcarbonyloxy group having 1 to 5 carbon atoms in the alkyl moiety (for example, an acetyloxy group), etc.

L represents a methine group, and n represents an integer of 0, 1 or 2. The methine group composing the methine chain represented by $=L—(L=L)_n—$ can be substituted with an alkyl group having 1 to 3 carbon atoms (for example, a methyl group, an ethyl group or an isopropyl group, etc.), a phenyl group, a benzyl group, a phenethyl group or a halogen atom (for example, a chlorine atom or bromine atom).

Preferred dyes used in the present invention are those having formula (1) wherein the substituent R represents an alkylene group or an alkylene group, the substituent, X is a phenyl group ($—X_1$), phenyl carbamoyl group ($—CONHX_1$), or a phenyl ureido group ($—NHCONHX_1$).

Examples of the oxonol dyes which can be used in the present invention are described in the following. However, the dyes of the present invention are not to be construed as being limited to these examples.

Dye 1

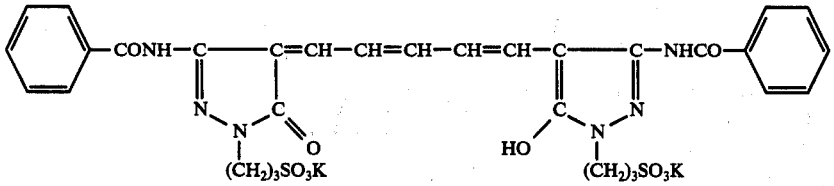

Dye 2

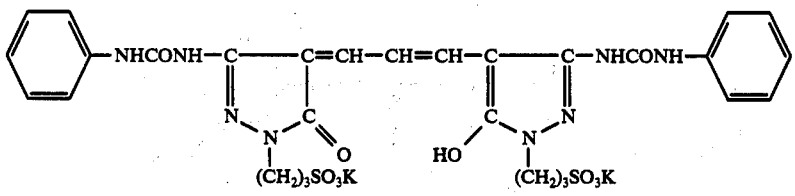

Dye 3

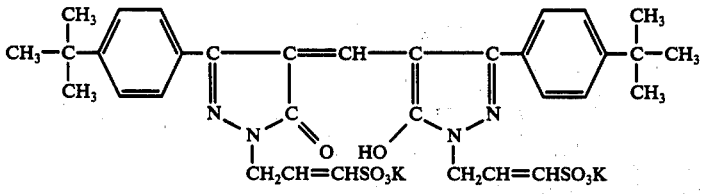

Dye 4

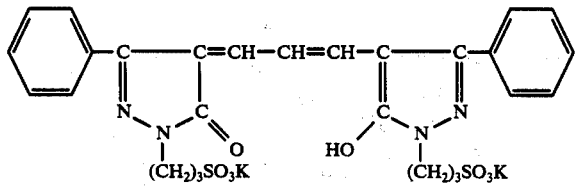

Dye 5
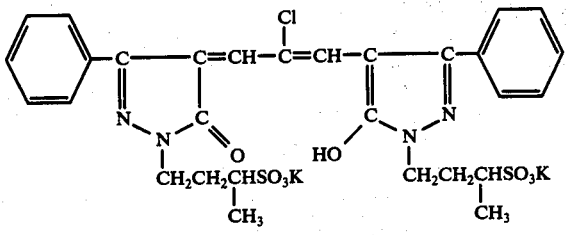
Dye 6
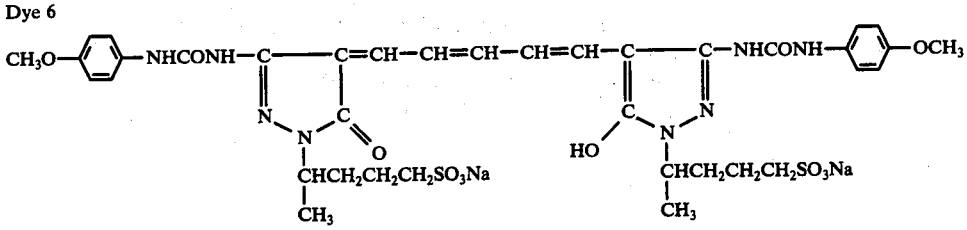
Dye 7
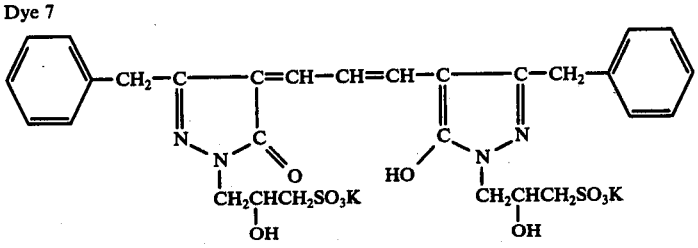
Dye 8
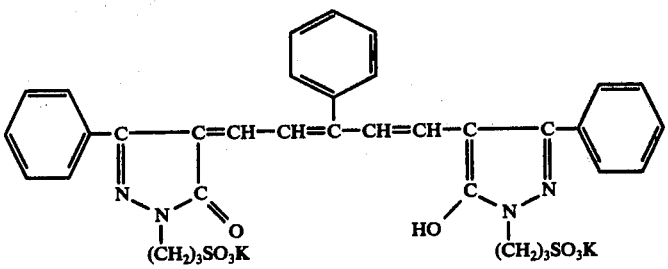
Dye 9
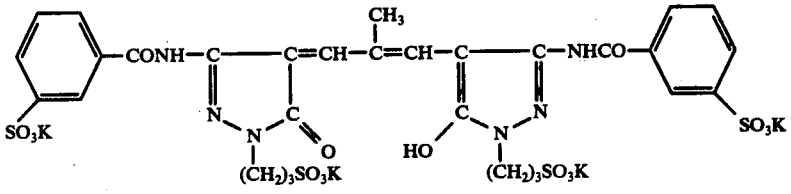
Dye 10
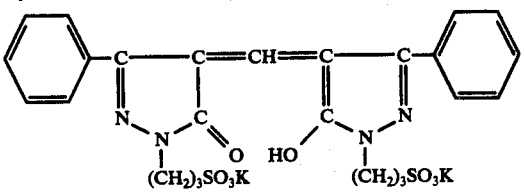
Dye 11
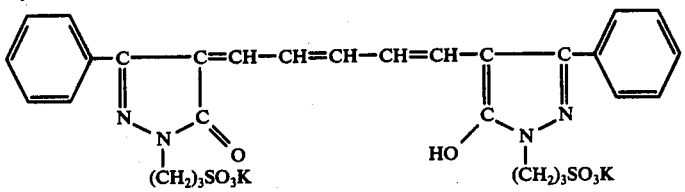

Dye 12
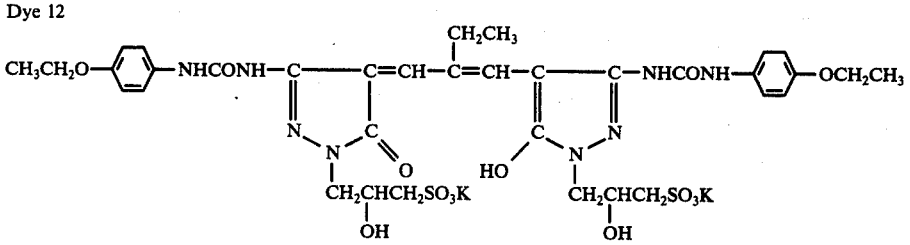
Dye 13
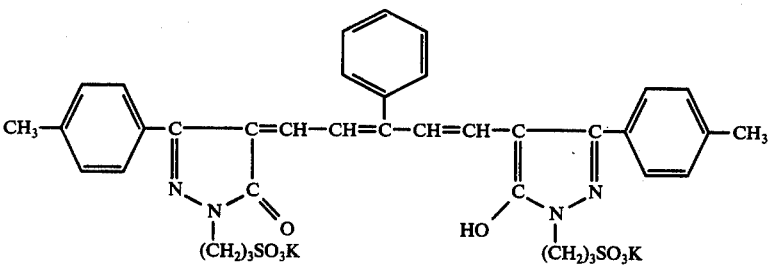
Dye 14
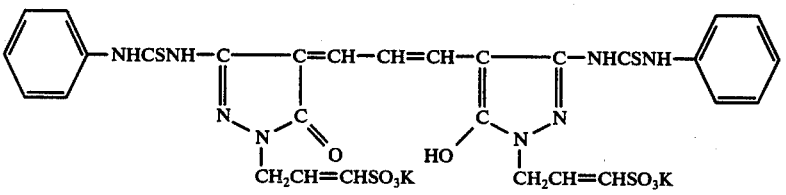
Dye 15
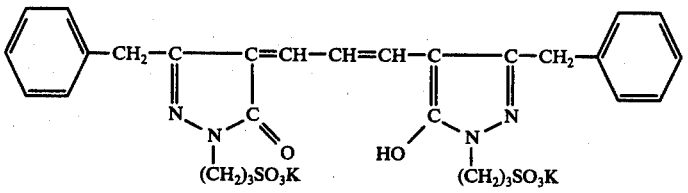
Dye 16
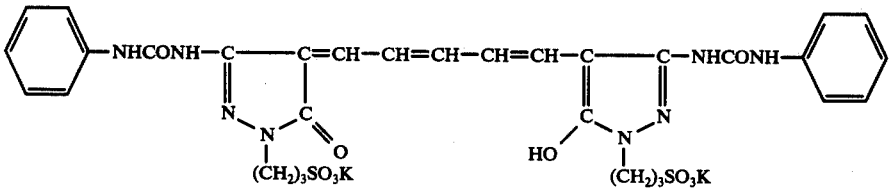
Dye 17
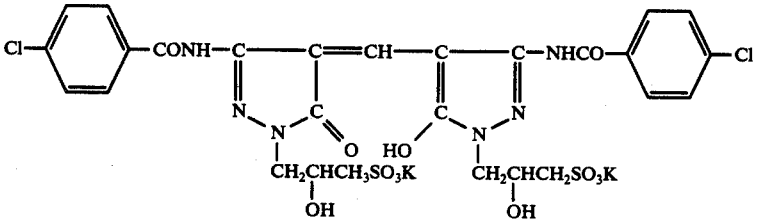
Dye 18
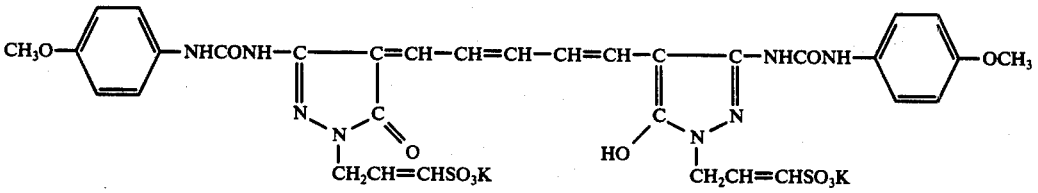

Dye 19

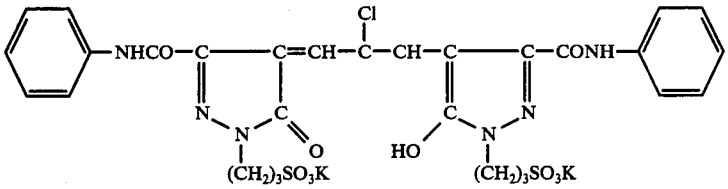

Dye 20

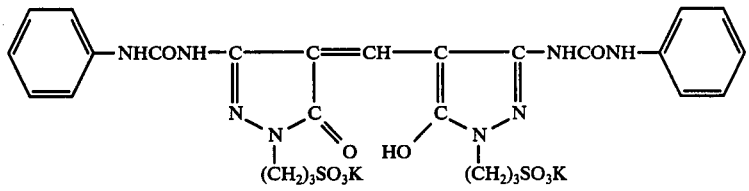

The oxonol dyes represented by formula (I) can be synthesized by condensing a pyrazolone represented by the following formula (II) with a compound represented by the following formula (III*b*), (III*c*), (III*d*) or (III*e*) in the presence of a base.

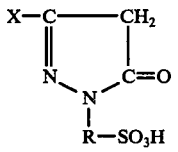

(II)

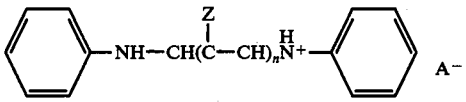

(IIIa)

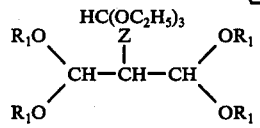

(IIIb)
(IIIc)

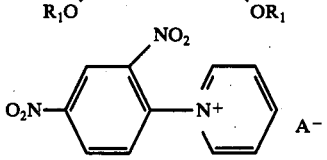

(IIId)

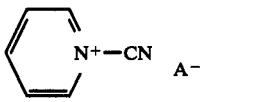

(IIIe)

In the above formulae, R, X and *n* each have the same meanings as described above, Z represents a hydrogen atom, an alkyl group such as a $C_1$–$C_3$ alkyl group, e.g., methyl, a halogen atom, e.g., chlorine or bromine, or a phenyl group. A represents an anion (for example, chloride, bromide, iodide, perchlorate, methylsulfate, ethylsulfate or p-toluenesulfonate, etc.), and $R_1$ represents a methyl group or an ethyl group.

Some examples of the synthesis of the dyes of the present invention are illustrated below. Unless otherwise indicated herein all parts, percents, ratios and the like are by weight.

SYNTHESIS EXAMPLE 1

(Synthesis of dye 1)

A mixture of 6.5 g of 3-benzoylamino-1-(γ-sulfopropyl)-5-pyrazolone, 2.84 g of glutaconic-aldehyde-dinail hydrochloride, 40 ml of methanol, 30 ml of N,N-dimethylacetamide and 8 g of tri-n-butylamine was stirred at 10°–15° C for 4 hours. The reaction solution gradually became blue. A solution of 2 g of anhydrous potassium acetate in 20 ml of methanol was added thereto to yield a blue precipitate. After being stirred at room temperature (about 20°–30° C) for 1 hour, the precipitate was separated by filtration, washed with acetone and dried to produce 5.2 g of blue crystals. An aqueous solution of this dye was blue and the maximum absorption wavelength thereof was 625 mμ.

SYNTHESIS EXAMPLE 2

(Synthesis of Dye 2)

A mixture of 6.8 g of 3-phenylureido-1-(γ-sulfopropyl)-5-pyrazolone, 2 g of 1,1,3,3-tetramethoxypropane, 50 ml of methanol and 2 g of triethylamine was refluxed on a water bath for 3 hours with heating. Then, a solution of 2 g of anhydrous potassium acetate in 20 ml of methanol was added thereto. The precipitated dark red crystals were separated by filtration, washed with methanol and acetone and dried to obtain 4.8 g of dark red crystals. An aqueous solution of this dye was red and the maximum absorption wavelength thereof was 508 mμ.

SYNTHESIS EXAMPLE 3

(Synthesis of Dye 4)

A mixure of 5.6 g of 3-phenyl-1-(γ-sulfopropyl)-5-pyrazolone, 2.6 g of malondialdehyde hydrochloride, 50 ml of methanol and 5 g of triethylamine was refluxed on a water bath for 3 hours with heating. Then a solution of 3 g of anhydrous potassium actate in 50 ml of methanol was added thereto and the mixture was refluxed for 5 minutes to precipitate dark red crystals. These crystals were separated by filtration, washed with methanol and then with acetone, and dried to obtain 4.8 g of the desired dye. An aqueous solution of this dye was red and the maximum absortion wavelength thereof was 525 mμ.

SYNTHESIS EXAMPLE 4

(Synthesis of Dye 10)

A mixture of 5.6 g of 3-phenyl-1-(γ-sulfopropyl)-5-pyrazolone, 2.0 g of ethyl orthoformate, 4.0 g of triethylamine, and 30 ml of methanol was refluxed for 4 hours with heating. Then, a solution of 3 g of anhydrous potassium acetate in 20 ml of methanol was added thereto and the mixture was refluxed for 5 minutes to precipitate yellow crystals. These crystals were separated by filtration, washed with methanol and then with acetone sufficiently, and dried to obtain 3.8 g of a yellow dye. An aqueous solution of this dye was yellow and the absorption maximum wavelength thereof was 450 mμ.

SYNTHESIS EXAMPLE 5

(Synthesis of Dye 11)

A mixture of 5.9 g of 3-(4'-tolyl)-1-(γ-sulfopropyl)-5-pyrazolone, 2.8 g of 2,4-dinitrobenzene pyridinium hydrochloride, 5 g of triethylamine, 15 ml of methanol and 30 ml of N,N-dimethylformamide was stirred at room temperature for 4 hours. The reaction solution became blue as the reaction proceeded. After being stirred for 5 hours, a solution of 3 g of anhydrous potassium acetate in 20 ml of methanol was added thereto. Then, 200 ml of acetone was added thereto to precipitate dark green crystals. These crystals were separated by filtration, washed with methanol and then with acetone sufficiently, and dried to obtain 2.8 g of blackish-blue crystals. An aqueous solution of this dye was deep blue and the maximum absorption wavelength thereof was 638 mμ.

SYNTHESIS EXAMPLE 6

(Synthesis of Dye 20)

A mixture of 6.8 g of 3-phenylureido-1-(γ-sulfopropyl)-5-pyrazolone, 1.96 g of diphenylformamidine, 4.0 g of triethylamine and 20 ml of N,N-dimethylformamide was refluxed for 30 minutes with heating. Then, a solution of 2.0 g of anhydrous potassium acetate in 20 ml of methanol was added thereto. After the mixture was refluxed for 5 hours, it was cooled with water. The precipitated yellow crystals were separated by filtration, washed with methanol and acetone and dried to obtain 4.8 g of the yellow dye. An aqueous solution of this dye was yellow and the maximum absorption wavelength was 395 mμ.

The dyes can be incorporated into hydrophilic colloid layers in the photographic sensitive elements of the present invention using a conventional process. Namely, an aqueous solution of the dye having a suitable concentration is added to an aqueous solution of the hydrophilic colloid and the resulting solution is applied to a support or to another layer of the photographic sensitive element using known methods.

The amount of the dye to be added to the aqueous solution of the hydrophilic colloid can be decided suitably within the range of the solubility of the dye depending on the purpose. In general, an aqueous solution of the dye preferably having a concentration of about 0.5 to 3% is applied in an amount of about 80 to 800 mg of the dye per $m^2$ of the photosensitive material.

It is advantageous to add the dye to a coating solution for producing a basic polymer-containing hydrophilic colloid layer in the photosensitive elements of the present invention. However, the dye can be added to a coating solution for producing other hydrophilic colloid layers, that is, photographic emulsion layers, or to a coating solution for producing other non-light-sensitive layers. In the latter case, the dye preferably is introduced into a near layer and preferably an adjacent layer to the basic polymer-containing layer. Even if the dye is introduced into a layer which does not contain the basic polymer, the dye diffuses into the layer which contains the basic polymer and is concentrated in that layer. Consequently, the basic polymer containing layer is selectively dyed in the finished photosensitive elements. The dye can also be added to two or more layers.

The basic polymer containing hydrophillic colloid layer can be present as a single layer or as two or more layers. This layer (or these layers) can be positioned above the photographic emulsion layer (i.e., farther from the support), or can be positioned between photographic emulsion layers where a plurality of photographic emulsion layers is present or between the photographic emulsion layer and the support.

The layer dyed selectively due to the presence of the basic polymer can be used as a filter layer, as an antihalation layer or as a layer for other purposes according to the position of the dyed layer.

In the photosensitive elements of the present invention, the basic polymer is present in at least one hydrophilic colloid layer. Water soluble high molecular weight materials which have basic residues in their main chains or branched chains and which are compatible with gelatin, which are conventionally used for mordanting acid dyes for hydrophilic colloid layers of silver halide photographic sensitive elements, can be used as the basic polymer. For example, it is possible to use polymers derived from ethylenically unsaturated compounds having dialkylaminoalkyl ester residues described in British Pat. No. 685,475, copolymers of the above described compounds described in U.S. Pat. No. 2,839,401, maleic acid anhydride copolymers or derivatives thereof described in British Pat. No. 906,083, polymers prepared by reacting polyvinyl alkylketones with aminoguanidine described in British Pat. No. 850,281, polymers having a 2-methylimidazole nucleus in the side chain thereof described in U.S. Pat. No. 3,445,231, addition polymers of bisacrylamide and a secondary diamine and the quaternary salts thereof described in Japanese patent application (OPI) No. 24733/1973, terpolymers and 4-component polymers containing polyvinylpyridine or polyvinylquinoline described in British Pat. Nos. 765,520 and 766,202, and polymers described in German patent application (OLS) Nos. 1,914,361 and 1,914,362, etc.

Examples of hydrophilic colloids used in the photosensitive materials of the present invention include not only gelatin (lime processed or acid processed gelatin) but also gelatin derivatives, for example, gelatin derivatives produced by reacting gelatin with aromatic sulfonyl chlorides, acid chlorides, acid anhydrides, isocyanates or 1,4-diketones described in U.S. Pat. No. 2,614,928, gelatin derivatives produced by reacting gelatin with trimellitic acid anhydride described in U.S. Pat. No. 3,118,766, gelatin derivatives produced by reacting gelatin with active halogen containing organic acids described in Japanese patent publication No. 5514/1964, gelatin derivatives produced by reacting gelatin with aromatic glycidyl ethers described in Japanese patent publication No. 26845/1967, gelatin derivatives produced by reacting gelatin with maleimide, maleamic acid or unsaturated aliphatic diamines described in U.S. Pat. No. 3,186,846, sulfoalkylated gelatin described in British Pat. No. 1,033,189 and polyoxyalkylene derivatives of gelatin described in U.S. Pat. No. 3,312,353; high molecular weight grafted products of gelatin, for example, products produced by grafting one or more chains of vinyl monomers such as acrylic acid, methacrylic acid, or the mono or polyhydric alcohol esters thereof, the amides thereof, acrylonitrile (or methacrylonitrile), styrene and the like to gelatin; synthetic hydrophilic high molecular weight materials, for example, homopolymers and copolymers of vinyl alcohol, N-vinylpyrrolidone, hydroxyalkyl acrylates (hydroxyalkyl methacrylates), acrylamides(or metharylamides), and N-substituted acrylamides(or methacrylamides), copolymers of these monomers and acrylates(or methacrylates), vinyl acetate or styrene, and copolymers of the above described monomers and maleic acid anhydride or maleamic acid, etc.; and natural hydrophilic high molecular weight materials other than gelatin, for example, casein, agar-agar, alginic acid, and polysaccharides. These materials can be used individually or as a mixture of two or more thereof.

Various coating methods such as a dip coating method (including using an air knife), a curtain coating method or an extrusion coating method (including a method using the hopper described in U.S. Pat. No. 2,681,294), etc., can be used to produce the hydrophilic colloid layer containing the dye of the present invention or the hydrophilic colloid layer containing the basic polymer. Two or more layers can be coated at the same time using the method described in U.S. Pat. Nos. 2,761,791 and 2,941,898.

Both transparent and opaque supports generally used for photographic elements can be used as the support. Examples of suitable supports include glass plates of glasses such as soda glass, potash galss, borosilicate glass or quartz glass; films composed of synthetic high molecular weight materials such as polyalkyl acrylates(or methacrylates), polystyrene, polyvinyl chloride, partially formulated polyvinyl alcohol, polycarbonate, polyesters such as polyethylene terephthalate or polyamides such as nylon and films of semi-synthetic high molecular weight materials such as cellulose nitrate, cellulose acetate or cellulose acetate butyrate; paper, baryta coated paper, paper coated with $\alpha$-olefin polymers, synthetic paper composed of polystyrene, ceramics, and metals, etc.

The hydrophilic colloid layer containing the dye of the present invention can contain additives with various functions for improving the quality of the photosensitive material such as hardening agents, coating assistants, plasticizers, lubricating agents, matting agents, emulsion polymerization latexes, antistatic agents, ultraviolet light absorbing agents and antioxidants in addition to the hydrophilic colloid(s), the dye and the mordanting agent. These additives are illustrated in detail in the following.

In the light-sensitive element of the present invention, photographic emulsion layers and other hydrophilic colloidal layers can be hardened by adding a conventionally used hardener. Various kinds of compounds, individually or in combination, such as aldehydes (e.g., glyoxal described in U.S. Pat. No. 1,870,354, glutaraldehyde described in British Pat. No. 825,544, etc.), N-methylol compounds (e.g., N,N'-dimethylolurea, dimethylolhydantoin described in British Pat. No. 676,628, etc.), dioxane derivatives (e.g., dihydroxydioxane described in U.S. Pat. No. 3,380,829, derivatives thereof described in Japanese patent publicaton No. 38713/71, etc.), epoxy group-containing compounds (e.g., compounds described in U.S. Pat. Nos. 3,047,394, 3,091,537, Japanese patent publication No. 7133/59, etc.), compounds containing reactive halogens (e.g., 2,4-dichloro-6-hydroxy-1,3,5-triazine, described in U.S. Pat. No. 3,325,287, mucohalic acids (e.g., mucochloric acid described in U.S. Pat. No. 2,080,019, mucobromic acid, the derivatives thereof described in Japanese patent publication No. 1,872/71, etc.), bis(methanesulfonic acid ester) described in U.S. Pat. No. 2,726,162, sulfonyl compounds (e.g., bis(benzenesulfonyl chloride) described in U.S. Pat. No. 3,725,925, etc.), aziridine compounds (e.g., compounds described in Japanese patent publication Nos. 4212/58 and 8790/62, etc.), divinylsulfones (e.g., compounds described in U.S. Pat. No. 2,579,871, etc.), compounds containing a reactive olefin bond (e.g., divinylketones as described in German Pat. No. 872,153, compounds containing an acryloyl group described in U.S. Pat. Nos. 3,255,000, 3,635,718, British Pat. No. 994,869, West German Pat. No. 1,090,427, etc.), alkylenebismaleimides described in U.S. Pat. No. 2,992,109, etc.), isocyanates described in U.S. Pat. No. 3,103,437, carbodiimides described in U.S. Pat. No. 3,100,704, isoxazole derivatives (e.g., compounds described in U.S. Pat. No. 3,321,313, 3,543,292, etc.), carbamoyl chloride derivatives described in Japanese patent publication No. 6899/66, high molecular weight hardeners (e.g. dialdehyde starch described in U.S. Pat. No. 3,057,723, compounds described in Japanese patent publication No. 12550/67, etc.), inorganic hardeners (e.g., chromium alum, chromium acetate, zirconium sulfate, etc.), and the like can be used as the hardener.

The photographic emulsion layers and other hydrophilic colloidal layers in the light-sensitive elements of the present invention can contain various known surface active agents as a coating aid or for antistatic purposes, improvement of sliding properties and other purposes. For example, nonionic surface active agents such as saponin, polyethylene glycol, polyethylene glycol-polypropylene glycol condensates described in U.S. Pat. No. 3,294,540, polyalkylene glycol ethers described in U.S. Pat. No. 2,240,472 and 2,831,766, polyalkylene glycol esters, polyalkylene glycol amides, and the like; anionic surface active agents such as alkylcarboxylic acid salts, alkylsulfonic acid salts, alkylbenzensulfonates, alkylnaphthalenesulfonates, alkylsulfates, N-acylated N-alkyltaurines described in U.S. Pat. No. 2,739,891, maleopimelates described in U.S. Pat. Nos. 2,359,980, 2,409,930, and 2,447,750, the compounds described in U.S. Pat. Nos. 2,823,123 and 3,415,649, and the like; and amphoteric surface active agents such as the compounds described in British Pat. No. 1,159,825, Japanese patent publication No. 378/65, Japanese patent application (OPI) No. 43924/73, U.S. Pat. No. 3,726,683, etc., can be used.

The hydrophilic colloidal layers in the light-sensitive element of the present invention can contain a lubricating agent such as the higher alcohol esters of higher fatty acids described in U.S. Pat. Nos. 2,588,756 and 3,121,060; casein described in U.S. Pat. No. 3,295,979, higher fatty acid calcium salts described in British Pat. No. 1,263,722, and silicone compounds described in British Pat. No. 1,313,384, U.S. Pat. Nos. 3,042,522 and 3,489,567. A dispersion of liquid paraffin can also be used for this purpose.

The photographic emulsion layers and other hydrophilic colloidal layers in the light-sensitive element of the present invention can contain a plasticizer such as glycerin, diols described in U.S. Pat. No. 2,960,404, trihydric aliphatic alcohols described in U.S. Pat. No. 3,520,694, or the like.

The photographic emulsion layers and other hydrophilic colloidal layers in the light-sensitive element of the present invention can contain a dispersion of a water-insoluble synthetic polymer or of a polymer slightly soluble in water for the purpose of improving the dimensional stability and the like. For example, polymers containing as a monomer alkyl acrylates, alkyl methacrylates, alkoxy acrylates, alkoxy methacrylates, glycidyl acrylate, glycidyl methacrylate, acrylamide, methacrylamide, vinyl acetate, acrylonitrile, olefins or styrene, individually or in combination or containing these monomers and acrylic acid, $\alpha,\beta$-unsaturated dicarboxylic acids, sulfoalkyl acrylates, styrenesulfonic acid or the like can be used. As specific examples, there are illustrated the polymers in U.S. Pat. Nos. 2,376,055, 3,607,290, 3,645,740, British Pat. Nos. 1,186,699, 1,307,373, U.S. Pat. Nos. 3,062,674, 2,739,137, 3,411,911, 3,488,708, 3,635,715, 2,853,457.

The hydrophilic colloidal layers in the light-sensitive element of the present invention can contain a matting agent such as inorganic particles, e.g., silica described in Swiss Pat. No. 330,158, glass powder described in Frech Pat. No. 1,296,995, carbonates of alkaline earth metals, cadmium or zinc described in British Pat. No. 1,173,181; starch described in U.S. Pat. No. 2,322,037; and organic particles, e.g., starch derivatives described in Belgian pat. No. 625,451 or British Pat. No. 981,198; polyvinyl alcohol described in Japanese patent publication No. 3643/69, polystrene or polymethyl methacrylate described in Swiss Pat. No. 330,158, polyacrylonitrile described in U.S. Pat. No. 3,079,257 and polycarbonates described in U.S. Pat. No. 3,022,169.

The photographic emulsion layers and other hydrophilic collodial layers in the light-sensitive element of the present invention can contain an ultraviolet light-absorbing agent such as the compounds of the benzophenone series, the benzotriazole series, the thiazolidine series or the like. These ultraviolet light-absorbing agents can be mordanted to a specific layer in the same manner as with the dyes.

The photographic emulsion layers and other hydrophilic colloidal layers in the light-sensitive element of the present invention can contain a brightening agent of the stilbene series, the triazine series, the oxazole series, the coumarin series or the like. Water-soluble compounds can be used and, in addition, water-insoluble brightening agents can be used in the form of a dispersion.

The emulsion layers and another hydrophilic colloid layers of the photosensitive elements may contain another known water soluble dyes in the amount which does not adversely infuluence the effect of the present invention together with the water soluble dye according to the present invention. It is particularly advantageous to use a combination of two or more dyes when the desired spectral absorption characteristic can not be obtained by using only one dye. Examples of the dye capable of use include oxonol dyes described in Japanese patent publication (OPI) Nos. 85130/1973 and 5125/1974 and U.S. Pat. Nos. 3,247,127, 3,653,905, 2,533,472 and 3,379,533 and hemioxonol dyes described in British Pat. No. 584,609, U.S. Pat. No. 3,687,670 and French Pat. No. 1,421,679. Further, alkali soluble pigments such as manganese dioxide or bleachable pigments such as colloidal silver can be included together with the dye of the present invention.

The hydrophilic colloidal layer in the light-sensitive element of the present invention can contain compounds used for the purpose of preventing color fog of color light-sensitive materials or preventing color mixing between layers, such as alkylhydroquinones, dialkylhydroquinones, aryl-substituted hydroquinones, sulfo-substituted hydroquinones, high molecular weight compounds containing hydroquinone residues, catechol derivatives, aminophenol derivatives, gallic acid derivatives, ascorbic acids or the like in the form of, if necessary, a dispersion. Specific examples of these compounds are the compounds described in British Pat. Nos. 557,750, 557,802, U.S. Pat. Nos. 2,336,327, 2,360,290, 2,403,721, 2,728,659, 2,732,300, 2,735,765, 2,418,613, 2,675,314, 2,710,801, 2,816,028, 2,360,290, French Pat. No. 885,982, U.S. Pat. Nos. 2,336,327, 2,403,721, British Pat. No. 1,133,500, Japanese patent publication No. 13496/68, U.S. Pat. Nos. 3,457,079, 2,360,290, and 2,384,658. In order to introduce these compounds into a hydrophilic colloid layer, a method of dispersion in a hydrophilic colloid together with a high-boiling organic solvent such as an aliphatic ester, an aromatic carboxylic acid alkyl ester, an aromatic phosphoric acid ester, an aromatic ether, or the like, a method of addition as an alkaline aqueous solution to a hydrophilic colloid, and like methods can be employed.

The silver halide photographic emulsion can be used for the light-sensitive element of the present invention can be prepared using various conventionallly known techniques depending upon the end-use of the light-sensitive element so as to provide suitable characteristics.

Any of silver chloride, silver chlorobromide, silver bromide, silver bromoiodide, silver chlorobromoiodide and the like can be used as the silver halide, and the halogen content is not particulary limited. As a protective colloid used upon formation of the silver halide, gelatin derivatives such as acylated gelatin (e.g., phthaloylated gelatin, succinoylated gelatin, etc.) and grafted gelatin prepared by grafting acrylamide or hydroxyalkyl (meth)acrylate onto gelatin can be used as can high molecular weight polymers such as a copolymer comprising three monomers, acrylic acid (or methacrylic acid), acrylamide (or methacrylamide) and amine derivatives thereof (for example, N-(dialkylaminoalkyl)acrylamide), individually or in combination, as well as gelatin as is commonly used, can be employed.

Known processes can be employed for preparing the silver halide emulsion. For example, the principles and processes described in C. E. K. Mees & T. H. James, *The Theory of the Photographic Process,* 3rd Ed., Macmillan Co., New York (1966); P. Glafkides, *Chimie Photographique,* 2nd Ed., Photocinema Paul Montel, Paris (1957); H. Frieser, *Die Grundlagen der Photographische Prozesse mit Silverhalogeniden,* Vol. 2, pp. 609–674 and 735–743, Akademische Verlaggesellschaft, Frankfurt-am-Main, (1968); and the like can be used. Any of an acidic process, a neutral process and an ammoniacal process can be used, and a single jet or a double jet process (also called a twin jet process) can be used. The so-called controlled double jet process as described in Berichte der *Bunsengesellschaft fur Physikalische Chemie,* Bond 67, p. 349 et seq., (1963) can be used, as the occasion demands. Such a process is advantageous for obtaining an emulsion having an extremely narrow particle size distribution. The silver halide grains can be in any of a cubic form, an octahedral form, a tetradecahedral form (both of the foregoing two forms coexisting), various twin forms or in a mixed form thereof. The silver halide emulsion can contain either coarse grains or fine grains, with the mean value of grain diameter or edge length (or a corresponding value showing the grain size) (numerical average measured according to the projection method) being less than about 0.2 $\mu$m, about 0.2 to 1 $\mu$m or than about 1 $\mu$m. The grain size distribution (with the grain size being in the sense as described above) can be either narrow or broad. The silver halide emulsion can be either physically ripened or not physically ripened. Usually, soluble salts are removed from the emulsion after the formation of the precipitate or after physical ripening. As the means for salt removal, a noodle washing method, long well known, or a flocclation method utilizing inorganic salts containing a multivalent anion (e.g., ammonium sulfate, etc.), anionic surface active agents, anionic polymers (e.g., polystyrene-sulfonic acid, etc.) or gelatin derivatives (e.g., aliphatic or aromatic acylated gelatin, etc.) can be employed.

As the silver halide emulsion, an emulsion which has not been chemically sensitized (so-called non-after-ripened emulsion) can be used, although the emulsion can be chemically sensitized. Suitable processes for chemical sensitization include the processes described in Mees & James, supra, Glafkides, supra, or Frieser, supra, and other various known processes. That is, sulfur sensitizing using compounds containing a sulfur capable of reacting with silver ion such as a thiosulfate or the compounds described in U.S. Pat. Nos. 1,574,944, 2,278,947, 2,410,689, 3,189,458, 3,501,313, French Patent 2,059,245 or using active gelatin; reduction sensitization using a reducing agent such as stannous chloride described in U.S. Pat. No. 2,487,850, amines described in U.S. Pat. No. 2,518,698, 2,512,925, 2,521,926, 2,419,973 and 2,419,975, iminoaminomethanesulfinic acid described in U.S. Pat. No. 2,983,610 or silane compounds described in U.S. Pat. No. 2,694,639, or according to the process described in H. W. Wood, *Journal of Photographic Science,* Vol. 1, p. 163 et seq. (1953); gold sensitization using a gold complex salt described in U.S. Pat. No. 2,399,083 or gold-thiosulfate complex salt; or sensitization using salts of noble metals such as platinum, palladium, iridium, rhodium, and rutherium described in U.S. Pat. Nos. 2,448,060, 2,540,086, 2,566,245 and 2,566,263, individually or in combination, can be employed. Also, selenium sensitization described in U.S. Pat. No. 3,297,446 can be used in place of or together with the sulphur sensitization.

The photographic emulsions used for producing the photosensitive element of the present invention can be spectrally sensitized to long wavelength blue light, green light, red light or infrared light using sensitizing dyes. Suitable sensitizing dyes include cyanine dyes, merocyanine dyes, complex cyanine dyes, complex merocyanine dyes, holopolar cyanine dyes, sty yl dyes, hemicyanine dyes, oxonol dyes and hemioxonol dyes. Cyanine dyes can be those containing a heterocyclic nucleus such as pyrroline, oxazoline, thiazoline, pyrrole, oxazole, thiazole, selenazole, imidazole, or pyridine, etc., as a basic nucleus. These nuclei can be substituted with substitutents such as alkyl groups, alkylene groups, hydroxyalkyl groups, carboxyalkyl groups, sulfoalkyl groups, aminoalkyl groups, alkoxyalkyl groups, sulfo-hydroxyalkyl groups or sulfoalkoxyalkyl groups, etc. These nuclei can be fused to a hydrocarbon ring or heterocyclic ring which is unsubstituted or is substituted with substituents such as a halogen atom, an alkyl group, an alkoxy group, a hydroxy group, a cyano group, a carboxyl group, an alkoxycarbonyl group, an alkylamino group, a dialkylamino group, an acylamino group, a phenyl group or a fluoroalkyl group, etc. The cyanine dyes can be symmetric or asymetric and the methine or polymethine chain of the dyes can be substituted with an alkyl group, a phenyl group, a substituted phenyl group such as a carboxyphenyl group, an isophorone nucleus or a heterocyclic nucleus. Suitable merocyanine dyes include those having the above described basic nucleus and an acid nucleus such as 2-thiozazolidinedione, rhodanine, thiohydantoin, barbituric acid or thiobarbituric acid, etc. The above described acid nucleus can be substituted with substituents such as an alkyl group, an alkylene group, a phenyl group, a hydroxyalkyl group, a carboxyalkyl group, a sulfoalkyl group, an alkoxyalkyl group, an acylamino group or a heterocyclic nucleus, etc. These sensitizing dyes can be used individually or as a combination of two or more thereof. Quite a large number of combinations of sensitizing dyes for supersensitization are known.

The emulsions can contain substrates having a supersensitization function without substantially absorbing visible light, for example, compounds having a pyridinylamino group or a triazinylamino group described in U.S. Pat. Nos. 2,933,390, 3,511,664, 3,615,613, 3,615,632 and 3,615,641, etc., aromatic acid-formaldehyde condensation products described in British Patent 1,137,580, azaindenes or cadmium salts together with the sensitizing dyes.

The photographic emulsions in the light-sensitive element of the present invention can contain various additives for the purpose of preventing fog or stabilizing the photographic properties during production steps, during storage of the light-sensitive material or during development processing. That is, azoles (e.g., benzotriazole, benzothiazolium salts described in U.S. Pat. No. 2,131,038, aminobenzimidazole described in U.S. Pat. No. 2,324,123, etc.); nitroazoles (e.g., nitrobenzindazole, nitrobenzotriazole, nitrobenzimidazoles described in British Pat. No. 403,789, nitrobenzimidazoles described in U.S. Pat. No. 2,324,123, etc.); halogen-substituted azoles (e.g., 5-chlorobenzimidazole, 5-bromoimidazole, 6-chlorobenzimidazole, etc.); mercaptoazoles (e.g., mercaptothiazole derivatives described in U.S. Pat. No. 2,824,001, mercaptobenzothiazole, the derivatives thereof described in U.S. Pat. No. 2,697,099, mercaptoimidazole derivatives described in U.S. Pat. No. 3,252,799, mercaptobenzimidazole, mercaptoxadiazole described in U.S. Pat. No. 2,843,491, mercaptothiadiazole described in U.S. Pat. No. 1,758,576, phenylmercaptotetrazole described in U.S. Pat. No. 2,403,927, etc.); mercaptopyrimidine described in U.S. Pat. No. 2,304,962; mercaptotriazine described in U.S. Pat. No. 2,476,536; mercaptotetrazaindene described in British Pat. No. 893,428; various mercapto compound (e.g., thiosalicylic acid described in U.S. Pat. No. 2,377,375, thiobenzoic acid described in U.S. Pat. No. 3,226,231, sugar mercaptal described in Japanese patent publication No. 8,743/72, etc.); oxazolinethione described in U.S. Pat. No. 3,251,691; triazolothiadiazole described in Japanese patent publication No. 17932/68; and the like can be added. Also, nitrogen-containing heterocyclic compounds having an antifogging action such as azaindene compounds (e.g., tetrazaindenes such as the compounds described in U.S. Pat. Nos. 2,444,605, 2,444,606, 2,450,397, Japanese patent publication Nos. 10166/64, 10516/67; pentazaindenes such as the compounds described in U.S. Pat. No. 2,713,541, Japanese patent publication No. 13495/68), urazole compounds described in U.S. Pat. No. 2,708,161, etc., can be employed. Also, benzenesulfonic acid described in U.S. Pat. No. 2,394,198, benzenethiosulfonic acid, benzenesulfinic acid amide described in Japanese patent publication No. 4136/68, sugar mercaptal described in Japanese patent publication No. 8743/72, and the like can be added. Further, various chelating agents described in U.S. Pat. No. 2,691,588, British Pat. No. 623,488, Japanese patent publication Nos. 4941/68 and 13496/68 can be aded for preventing fog due to metal ions.

The photographic emulsion layers or other hydrophilic colloidal layers in the light-sensitive element of the present invention can contain, for example, polyalkylene oxides described in U.S. Pat. No. 2,441,389, the ethers, esters and amides of polyalkylene oxides described in U.S. Pat. No. 2,708,161, other polyalkylene oxide derivatives described in British Pat. No. 1,145,186, Japanese patent publication Nos. 10989/70, 15188/70, 43435/71, 8106/72 and 8742/72, thioether compounds described in U.S. Pat. Nos. 3,046,132 – 3,046,135 or Japanese patent publication Nos. 9019/70 and 11119/72, thiomorpholines described in Japanese patent publication No. 28325/72, quaternary ammonium compounds described in U.S. Pat. No. 3,772,021, pyrrolidines described in Japanese patent publication No. 27037/70, alcoxycarbonylamino, aryloxycarbonylamino or urea derivatives described in Japanese patent publication No. 23465/65, imidazole derivatives described in Japanese patent publication No. 45541/72, polymers described in Japanese patent publication No. 26471/70, 3-pyrazolidones described in Japanese patent publication No. 27670/70, for the purpose of increasing the sensitivity, enhancing the contrast or accelerating development.

To the photographic emulsions of the light-sensitive element of the present invention can be added inorganic or organic mercury compounds for sensitizing or antifogging purposes. For example, mercury complex salts described in U.S. Pat. No. 2,728,664, benzothioazole mercury salts described in U.S. Pat. No. 2,728,667, mercury salts adducts described in U.S. Pat. No. 2,728,663 and 2,732,302, and organic mercury compounds described in U.S. Pat. Nos. 2,728,665 and 3,420,668 can be used.

Where the silver halide grain size is particularly small (less than about 0.4 μm or less than about 0.2 μm), the compounds described in, e.g., British Pat. Nos. 1,316,493, 1,317,138, 1,317,139, 1,317,709, 1,297,901 and West German patent application OLS No. 2,235,031 can be added as a sensitizing agent to the photographic emulsions of the light-sensitive material of the present invention.

The photographic emulsion layers in the light-sensitive element of the present invention can contain a conventionally used, non-diffusible, dye image-forming complex. A dye image-forming coupler (hereinafter abbreviated "color coupler") is a compound capable of forming a dye image by reaction, upon photographic development, with an oxidation product of an aromatic primary amine developing agent. The color couplers can be either a 4-equivalent type or a 2-equivalent type or, also, they can be colored couplers for color correction or couplers capable of releasing a development inhibitor. As a yellow-forming coupler, there can be usefully used open-chain ketomethylene type compounds such as acylaminoacetamide compounds, as a magenta-forming coupler, pyrazolone compounds or cyanoacetyl compounds and, as a cyan-forming coupler, naptholic or phenolic compounds. Couplers can be introduced into the photographic emulsion layers using methods commonly employed for multi-color light-sensitive materials.

The present invention can also be applied to a multilayer photographic element comprising a support having thereon at least two light-sensitive layers having a different spectral sensitivity. Multi-layer color photographic elements usually comprise a support having thereon at least one red-sensitive silver halide emulsion layer, one green-sensitive silver halide emulsion layer and one blue-sensitive silver halide emulsion layer. The sequence of these layers can be optionally selected as required. Usually the red-sensitive silver halide emulsion layer is combined with a cyan-forming coupler, the green-sensitive silver halide emulsion layer with a magenta-forming coupler, and the blue-sensitive silver halide emulsion layer with a yellow-forming coupler, through different combinations can be used in certain cases.

The photographic emulsion layers and other hydrophilic colloidal layers in the light-sensitive element of the present invention can contain, individually or in combination, developing agents such as aromatic diols (e.g., hydroquinone, etc.), aminophenols, phenylenediamines, 3-pyrazolidones, ascorbic acid or derivatives thereof. The combination of hydroquinone and an N-hydroxyalkyl-substituted p-aminophenol derivative described in Japanese patent publication No. 43814/73 is particularly advantageous. When the developing agents are water-insoluble, they can be added as a dispersion.

As a support, there can be used either transparent or opaque supports usually used for photographic elements such as glass plates comprising soda glass, potash glass, borosilicate glass, quartz glass, or a like glass; films comprising synthetic high polymers of polyalkyl acrylates, polyalkyl methacrylates, polystyrene, polyvinyl chloride, partially formulated polyvinyl alcohol, polycarbonate, polyesters (e.g., polyethylene terephthalate, etc.) or polyamides; films comprising cellulose derivatives (e.g., cellulose nitrate, cellulose acetate, cellulose acetate butyrate, etc.); paper; baryta-coated paper; α-olefin polymer-coated paper; synthetic papers comprising polystyrene or the like; ceramics; metals; and the like.

The photographic emulsion layers and other layers of the light-sensitive element of the present invention can be coated according to various known coating methods. Suitable coating methods include a dip coating method, an air knife coating method, a roller coating method, a curtain coating method and an extrusion coating method. The method described in U.S. Pat. No. 2,681,294 is an advantageous method. Also, two or more layers can be coated at the same time using the method described in, e.g., U.S. Pat. Nos. 2,761,791 and 3,526,528.

The light-sensitive element of the present invention can contain an antistatic layer or an electrically conductive layer, e.g., a metal layer formed by vacuum evaporation or electrodeposition or an ionic polymer.

All known processes can be used for the photographic processing of the light-sensitive element of the present invention. Known solutions can be used as the processing solution, with the processing temperatures being less than about 18° C, about 18° C to about 50° C and higher than about 50° C.

To the light-sensitive element of the present invention can be applied any development processings for forming silver images (black-and-white photographic processing) and color photographic processings (development processing for forming a dye image).

In the case of subjecting the light-sensitive element of the present invention to a black-and-white photographic processing, the developer used can contain a known developing agent. As the developing agent, there can be used, individually or in combination, dihydroxybenzenes (e.g., hydroquinone, chlorohydroquinone, bromohydroquinone, 2,3-dichlorohydroquinone, methylhydroquinone, isopropylhydroquinone, 2,5-dimethylhydroquinone, etc.), 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, etc.), aminophenols (e.g., o-aminophenol, p-aminophenol, N-methyl-o-aminophenol, N-methyl-p-aminophenol, 2,4-diaminophenol, etc.), pyrogallol, ascorbic acid, 1-aryl-3-pyrazolines (e.g., 1-(p-hydroxyphenyl)-3-aminopyrazoline, 1-(p-methylaminophenyl)-3-aminopyrazoline, 1-(p-aminophenyl)-3-aminopyrazoline, 1-(p-amino-m-methylphenyl)-3-aminopyrazoline, etc.) and the like.

To the developer can be added, if desired, a preservative (e.g., sulfites, bisulfites, ascorbic acid, etc.), an alkali agent (e.g., hydroxides, carbonates, etc.), a pH buffer (e.g., carbonates, borates, boric acid, acetic acid, citric acid, alkanolamines, etc.), a dissolving aid (e.g., polyethylene glycols, the esters thereof, alkanolamines, etc.), a sensitizing agent (e.g., nonionic surface active agents containing a polyoxyethylene chain, quaternary ammonium compounds, etc.), a surface active agent, an antifogging agent (e.g., halides such as potassium bromide and sodium bromide, nitrobenzindazole, nitrobenzimidazole, benzotriazole, benzothiazole, tetrazoles, thiazoles, etc.), a chelating agent (e.g., ethylenediaminetetraacetic acid or the alkali metal salts thereof, nitrilotriacetic acid or the alkali metal salts or the ammonium salts thereof, polyphosphates, etc.), a development accelerator (e.g., the compounds described in U.S. Pat. No. 2,304,025 and Japanese patent publication No. 45541/72, etc.), a hardener (e.g., glutaraldehyde, etc.), and the like.

A so-called "lith-type" development processing can be applied to the light-sensitive element of the present invention. "Lith-type" development processing means a development processing in which the development is conducted in an infectious manner under a low sulfite ion concentration, usually using dihydroxybenzenes as a developing agent, for the photographic reproduction of line images or the photographic reproduction of half tone images through half tone dots. The details of such are described in Mason, *Photographic Processing Chemistry,* pp. 163–165 (1966).

As a special type of development processing, a process of incorporating a developing agent in a light-sensitive material (for example, in an emulsion layer) and processing the lightsensitive element in an alkaline aqueous solution to effect development can be employed. This type of development processing is often utilized as one system of rapidly processing a lightsensitive material in combination with a silver salt-stabilizing processing using a thiocyanate or the like and, in the present invention, such processing can be used. In using such rapid processing, the effect of the present invention is particularly marked.

As the fixing solution, a fixing solution of a generally used composition can be used. A fixing solution is generally an aqueous solution comprising a fixing agent, a hardener and other additives, the pH of the solution being usually about 3.8 to 5.0. Organic sulfur compounds, well known as fixing agents, capable of producing a soluble stable silver complex salt, as well as thiosulfates (e.g., sodium thiosulfate, potassium thiosulfate, ammonium thiosulfate, etc.) and thiocyanates (e.g., sodium thiocyanate, potassium thiocyanate, ammonium thiocyanate, etc.) can be used as the fixing agent.

A water-soluble aluminum salt, functioning as a hardener, such as aluminum chloride, aluminum sulfate, potassium alum, etc., is generally added to the fixing solution.

The dye images are formed in a conventional manner. For example, the negative-positive process as described in *The Journal of the Society of Motion Picture and Television Engineers,* 61, pp. 667–701 (1953); a color reversal process comprising imagewise exposure, forming a negative silver image by developing with a developer containing a black-and-white developing agent, a uniform exposure (or other suitable fogging processing) at least one time, and subsequently conducting color development to form a dye positive image; a process using a direct positive emulsion to obtain a dye positive image; and the like can be employed.

A color developer generally comprises an alkaline aqueous solution containing a color developing agent. Examples of color developing agents include known primary aromatic amine developing agents, for example, phenylenediamines (e.g., N,N-diethyl-p-phenylenediamine, N-ethyl-N-(β-hydroxyethyl)amino-2-methylaniline, 4-(N-ethyl-N-β-methanesulfonamidoethyl)amino-2-methylaniline, N,N-diethylamino-2-ethoxyaniline, etc.), p-aminophenols (e.g., 4-aminophenol, 2,6-dichloro-4-aminophenol, 2-bromo-4-aminophenol, etc.), and the like. The color developer can further contain common additives such as alkali metal sulfites, carbonates, bisulfites, bromides, iodides, alkaline buffers, etc. Further, if desired, a dye-forming coupler, a competitive coupler, an anti-fogging agent, a hardener, an anitoxidant, a thickening agent, and the like can be added.

According to the present invention, where a dyed hydrophilic colloid layer is provided on the photosensitive element as a filter layer or an antihalation layer or for other purposes, a sufficient absorption density is possible, even though the thickness of such a layer is reduced so as to have good resolving power. This is because the dye used in the present invention has high water solubility and good compatability with gelatin. Further, in the photosensitive materials of the present invention, no residual color remains on the photosensitive element after processing, because the dyed layer is easily and irreversibly decolored at photographic development.

Incorporation of the dye in the hydrophilic colloid layer in the photosensitive elements of the present invention does not adversely influence the photographic properties of the photographic emulsion layers. Namely, the sensitivity or gradation of the photographic emulsion layers is not deteriorated of softened except for that due to the filter effect of the dyed layer itself (where the emulsion layers are nearer the incident light of exposure than the dyed layer), and further the emulsion layers are not fogged. This is true for both the photographic properties in the intrinsic sensitive wavelength range of silver halide and those in the color range sensitized. Further, no degradation appears with the lapse of time after the preparation of the photosensitive materials.

In the photosensitive elements of the present invention, the dye is fixed in only the basic polymer containing layer and does not diffuse into other layers. Accordingly, unexpected deterioration of the sensitivity or gradation of the photographic emulsion layers which is caused by an undesired spectral absorption effect due to diffusion of the dye does not occur and, consequently, the photosensitive elements have good photographic properties and particularly excellent spectral characteristics. Particularly, this is very advantageous in black-white or color photographic sensitive materials where an antihalation layer is positioned between a photographic emulsion layer and the support and color photographic sensitive elements which comprise at least three photographic emulsion layers and a filter layer between the emulsion layers where the filter layer may have the function of an antihalation layer.

Namely, when the dye diffuses from the layer to be dyed into an emulsion layer which lies above it (i.e., farther from the support) or into a hydrophilic colloid layer which lies even further from the support, the emulsion layer is affected by the filter effect by such a dye and deteriorates in sensitivity and gradation softens.

In the photosensitive elements of the present invention, since such a diffusion of the dye does not happen, the deterioration of sensitivity of the emulsion layers which are above the dyed layer (farther from the support) can be substantially disregarded. Namely, such does not exceed about 0.06.

The present invention is illustrated in greater detail by reference to following examples.

EXAMPLE 1

A solution containing gelatin and having the following composition was prepared.

| | | |
|---|---|---|
| Gelatin | 40 g | |
| Water | 600 cc | |
| Poly(diethylaminoethyl methacrylate) | 60 cc | (5% aqueous solution) |
| Dye | 100 cc | (1% aqueous solution) |
| Hardening Agent* | 200 cc | (4% aqueous solution) |
| Phenoxypolyoxyethylene Butane Sulfonic Acid | 40 cc | (1% aqueous solution) |

*Sodium salt of 2,4-dichloro-6-hydroxy-1,3,5-triazine.

Dyes 1, 2, 3, 4, 7, 9, 10, 11, 13, 15, 16, 17 and 20 described above and Dyes A, B, C, D and E for comparison having the following formulae were used each as the dye in the above described composition.

Dye A

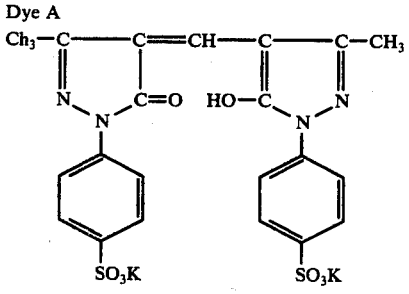

Dye B

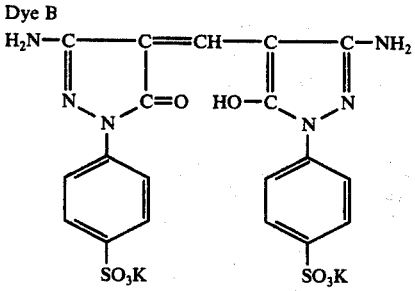

-continued

Dye C

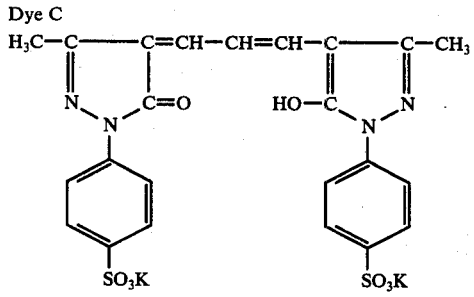

Dye D

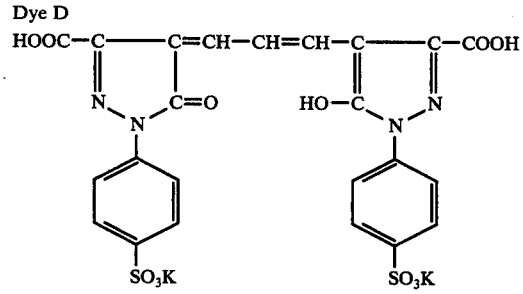

Dye E

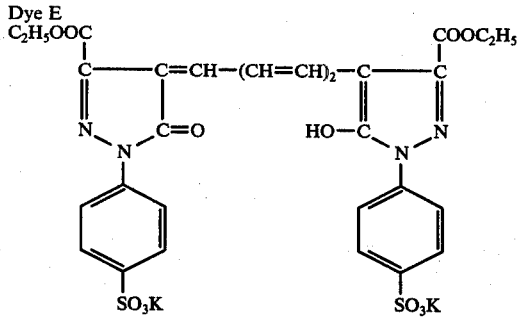

The prepared solutions were each coated on a cellulose acetate film so as to have a 4 microns of the dry thickness. The spectral absorption of each sample was determined.

Further, a solution having the following composition was applied to the above resulting layer in a thickness of 8 microns on a dry basis and it was dried so as to complete the drying in about 20 minutes.

| | |
|---|---|
| Gelatin | 40 g |
| Water | 980 cc |
| Sodium Dodecylbenzenesulfonate (1% aqueous solution) | 50 cc |

This sample was dipped with moving in warm water at 50° C for 5 minutes to remove the second layer which was applied without adding the dye and then the sample was dried. The spectral absorption of this sample was determined, in addition. The spectral density at the absorption maximum wavelength determined after coating of the first layer is designated $a_1$ and that of the first layer after coating of the second layer and removing the second layer is designated $a_2$. The dye fixing ratio in the first layer is represented by $p = (a_2/a_1) \times 100$. The values of P obtained for the samples above using each dye are shown in Table 1 below.

Table 1

| Dye | P |
|---|---|
| 1 | 90 |
| 2 | 95 |

Table 1-continued

| Dye | P |
|---|---|
| 3 | 90 |
| 4 | 95 |
| 7 | 92 |
| 9 | 87 |
| 10 | 92 |
| 11 | 93 |
| 13 | 94 |
| 15 | 90 |
| 16 | 95 |
| 17 | 89 |
| 20 | 93 |
| A (comparison) | 60 |
| B (comparison) | 25 |
| C (comparison) | 55 |
| D (comparison) | 50 |
| E (comparison) | 63 |

In the comparison samples using the known Dyes A–E, since the dyes diffuse into the second layer and are removed together with the second layer, the ratio of the dye remaining in the first layer is low. In the samples according to the present invention, a greater portion (above 80%) of the dye remained in the first layer without diffusing into the second layer.

EXAMPLE 2

To a cellulose acetate film having a subbing layer, a silver iodobromide emulsion containing a cyan forming coupler which was color-sensitized to red light was applied in a thickness of 5 μm. Then a gelatin intermediate layer having a thickness of 1.5 μm was produced on the resulting layer and a silver iodobromide emulsion containing a magenta forming coupler which was color-sensitized to green light was applied thereto in a thickness of 4 μm. The film was cut into five equal portions. To these films, five coating solutions, each having the following composition were applied, respectively to form a yellow filter layer having a thickness of 2 μm (the absorption density of the yellow filter layers at the maximum absorption wavelength is 0.9).

| 2A: | | |
|---|---|---|
| Aqueous Gelatin Solution | 10% | 500 cc |
| Poly(2-diethylaminoethyl methacrylate) | 5% | 220 cc |
| Dye A in Example 1 | 10% | 80 cc |
| Na Salt of 2,4-Dichloro-6-hydroxy-1,3,5-triazine | 1% | 25 cc |
| Dodecaethylene Glycol-4-Nonylphenol Ether | 2% | 30 cc |

2B:

The above described Dye B was used in Film 2A instead of Dye A. The amount of the solution (10%) added was 80 cc.

2C:

Dye 10 of this invention was used in Film 2A instead of Dye A. The amount of the solution (10%) added was 80 cc.

2D:

Dye 20 of this invention was used in Film 2A instead of Dye A. The amount of the solution (10%) added was 80 cc.

| 2E: | | |
|---|---|---|
| Aqueous Gelatin Solution (containing 8 g of Carey-Lea type yellow colloidal silver) | 6% | 500 g |
| Na Salt of 2,4-Dichloro-6-hydroxy-1,3,5-triazine | 1% | 25 cc |
| Polyethylene Glycol-4-Nonylphenol Ether | 2% | 30 cc |

Further, a blue-sensitive silver iodobromide emulsion containing a yellow forming coupler was applied in a thickness of 5 μm and then gelatin was applied to form a surface protective layer having a thickness of 1 μm. Thus, finished samples of color negative photosensitive materials were produced. These films were named Films 2A to 2E.

Each sample was exposed to light for 1/200 seconds through a Fuji color separation filter-Sp-1 (the spectral transmittance curve is shown in the figure) and a continuous gray wedge using a tungsten light source of a color temperature of 5500° K and then the sample was subjected to the following processings.

| Step | Temperature | Time |
|---|---|---|
| 1. Color Development | 37.8° C | 3½ minutes |
| 2. Water Wash | " | 1 minute |
| 3. Bleaching | " | 4½ minutes |
| 4. Water Wash | " | 1 minute |
| 5. Fixing | " | 6 minutes |
| 6. Water Wash | " | 1 minute |
| 7. Stabilizing | " | 1 minute |

Each processing solution used had the following composition.

| | |
|---|---|
| Color Developer: | |
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Tetrasodium Ethylenediamine Tetraacetate | 2 g |
| 4-Amino-3-methyl-N-ethyl-N-(β-hydroxyethyl)aniline Sesquisulfate (monohydrate) | 4 g |
| Water to make | 1 liter |
| Bleaching Solution: | |
| Sodium Salt of Ethylenediamine Tetraacetic Acid-Ferric Complex Salt | 100 g |
| Potassium Bromide | 50 g |
| Ammonium Nitrate | 50 g |
| Boric Acid | 5 g |
| Water to make | 1 liter |
| Fixing Solution: | |
| Sodium Thiosulfate | 150 g |
| Sodium Sulfite | 15 g |
| Borax | 12 g |
| Glacial Acetic Acid | 15 ml |
| Potassium Alum | 20 g |
| Water to make | 1 liter |
| Stabilizing Solution: | |
| Sodium Citrate | 5 g |
| Boric Acid | 5 g |
| Sodium Metaborate (tetrahydrate) | 3 g |
| Potassium Alum | 15 g |
| Water to make | 1 liter |

A photographic characteristic curve of the yellow image on each processed sample was produced and exposure necessary to obtain fog density +0.1 was determined. The sensitivity was evaluated as a reciprocal of the exposure amount. The resulting relative value of sensitivity and a degree of stain on each sample were as follows.

| Film No. | Relative Sensitivity of Yellow Image by Blue Light Exposure | Stain |
|---|---|---|
| 2A | 75 | None |
| 2B | 70 | None |
| 2C | 95 | None |
| 2D | 93 | None |

-continued

| Film No. | Relative Sensitivity of Yellow Image by Blue Light Exposure | Stain |
|---|---|---|
| 2E | 100 | Appeared |

In Films 2A and 2B wherein Dyes A and B for comparison were used, the sensitivity of the blue-sensitive emulsion layer was fairly well reduced as compared with that of the control Film 2E due to a filter effect based on the diffusion of the dye into the blue-sensitive emulsion layer from the yellow filter layer. Films 2C and 2D according to the present invention showed nearly the same sensitivity as that of the control Film 2E using colloidal silver in the yellow filter layer, and stains were not generated in these films as in Film 2E.

EXAMPLE 3

To a cellulose acetate film having a subbing layer, a silver iodobromide emulsion containing a cyan forming coupler which was color-sensitized to red light was applied in a thickness of 5μm. This film was divided into five equal portions. Then, as a gelatin intermediate layer, coating solutions having the following compositions 3A to 3E were each applied to form a magenta filter layer having a 1.5μm thickness. (The absorption density at the maximum absorption wavelength of the magenta filter layer was 0.4.)

| 3A | | |
|---|---|---|
| Aqueous Gelatin Solution | 10% | 500 cc |
| Poly(2-diethylaminoethyl methacrylate) | 5% | 220 cc |
| Dye 2 of the Invention | 10% | 40 cc |
| Na Salt of 2,4-Dichloro-6-hydroxy-1,3,5-triazine | 1% | 25 cc |
| Dodecaethylene Glycol-4-Nonylphenol Ether | 2% | 30 cc |

3B:

Dye 4 of the invention was used in 3A instead of Dye 2. The amount of the solution (10%) added was 40 cc.

3C:

The above described Dye C for comparison (as described in Example 1) was used in 3A instead of Dye 2. The amount of the solution (10%) was 40 cc.

3D:

The above described Dye D for comparison was used in 3A instead of Dye 2. The amount of the solution (10%) added was 40 cc.

| 3E: | | |
|---|---|---|
| Aqueous Gelatin Solution | 8% | 500 cc |
| Na Salt of 2,4-Dichloro-6-hydroxy-1,3,5-triazine | 1% | 25 cc |
| Dodecaethylene Glycol-4-Nonylphenol Ether | 2% | 30 cc |

To the formed layer, a silver iodobromide emulsion containing a magenta forming coupler which was color-sensitized to green light was applied in a thickness of 4 μm. Then the yellow filter layer described in Examples 2 to 2E was provided in a thickness of 2 μm. Further, a blue-sensitive silver iodobromide emulsion containing a yellow forming coupler was applied thereto in a thickness of 5 μm and finally a surface protective layer of gelatin was formed in a thickness of 1μm. The finished samples each corresponded to a color negative photosensitive material. These samples were designated Films 3A to 3E, respectively, according to the kind of magenta filter layer employed.

Each sample was exposed to light for 1/200 second through a Fuji Color Separation Filter Sp-2 (the spectral transmittance curve is shown in the figure) and a continuous gray wedge using a tungsten light source having a color temperature of 5500° K and then the sample was subjected to the following processings.

| Step | Temperature | Time |
|---|---|---|
| 1. Color Development | 37.8° C | 3½ minutes |
| 2. Water Wash | " | 1 minute |
| 3. Bleaching | " | 6 minutes |
| 4. Water Wash | " | 1 minute |
| 5. Fixing | " | 6 minutes |
| 6. Water Wash | " | 1 minute |
| 7. Stabilizing | " | 1 minute |

Each processing solution used had the following composition.

| | |
|---|---|
| Color Developer: | |
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Tetrasodium Ethylenediamine Tetraacetate | 2 g |
| 4-Amino-3-methyl-N-ethyl-N-(β-hydroxyethyl)aniline Sesquisulfate (monohydrate) | 4 g |
| Water to make | 1 liter |
| Bleaching Solution: | |
| Sodium Salt of Ethylenediamine Tetraacetic Acid-Ferric Complex Salt | 100 g |
| Potassium Bromide | 50 g |
| Ammonium Nitrate | 50 g |
| Boric Acid | 5 g |
| Water to make | 1 liter |
| Fixing Solution: | |
| Sodium Thiosulfate | 150 g |
| Sodium Sulfite | 15 g |
| Borax | 12 g |
| Glacial Acetic Acid | 15 ml |
| Potassium Alum | 20 g |
| Water to make | 1 liter |
| Stabilizing Solution: | |
| Boric Acid | 5 g |
| Sodium Citrate | 5 g |
| Sodium Metaborate (tetrahydrate) | 3 g |
| Potassium Alum | 15 g |
| Water to make | 1 liter |

A photographic characteristic curve of the magenta image of each processed sample was obtained and the exposure necessary to obtain fog density +0.1 was determined. The sensitivity was evaluated as the reciprocal of the exposure. The resulting relative value of sensitivity and the degree of stain on each sample were as follows.

| Film No. | Relative Sensitivity of Magenta Image by Green Light Exposure | Stain |
|---|---|---|
| 3A | 95 | None |
| 3B | 94 | None |
| 3C | 73 | None |
| 3D | 68 | None |
| 3E | 100 | None |

In Films 3C and 3D wherein Dyes C and D for comparison were used, the sensitivity of the green-sensitive emulsion layer was fairly well reduced as compared with that of the control Film 2E due to a filter effect based on a diffusion of the dye into the green-sensitive emulsion layer from the magenta filter layer. However, in Films 3A and 3B according to the present invention, diffusion of the dye into the green-sensitive emulsion layer was so little that it could be disregarded and the sensitivity was nearly the same as that in control Film 3E.

EXAMPLE 4

To a cellulose acetate film having a subbing layer, 4 coating solutions having the following compositions were applied, respectively, to form an antihalation layer having a thickness of 1 μm.

| 4A: | | |
|---|---|---|
| Aqueous Gelatin Solution | 10% | 500 cc |
| Poly(2-diethylaminoethyl-methacrylate) | 5% | 220 cc |
| Dye E for comparison | 10% | 32 cc |
| Na Salt of 2,4-Dichloro-6-hydroxy-1,3,5-triazine | 1% | 25 cc |
| Dodecaethylene Glycol-4-Nonylphenol Ether | 2% | 30 cc |

4B:

Dye 11 of the invention in 4A instead of Dye E for comparison. The amount of the solution 10% added was 32 cc.

4C:

Dye 16 of the invention was used in 4A instead of dye E for comparison. The amount of the solution 10% added was 32 cc.

| 4D: | | |
|---|---|---|
| Aqueous Gelatin Solution | 10% | 500 cc |
| Na Salt of 2,4-Dichloro-6-hydroxy-1,3,5-triazine | 1% | 25 cc |
| Dodecaethylene Glycol-4-Nonylphenol Ether | 2% | 30 cc |

To this layer, a silver iodobromide emulsion containing a cyan forming coupler which was color-sensitized to red light was applied in a thickness of 5 μm and then a gelatin intermediate layer was formed in a thickness of 1.5 μm. Further, a silver iodobromide emulsion containing a magenta forming coupler which was color-sensitized to green light was applied thereto in a thickness of 4 μm. To this layer a yellow filter layer described in Example 1 to 2E was applied in a thickness of 2 μm. Further, a blue-sensitive silver iodobromide emulsion containing a yellow forming coupler was applied thereto in a thickness of 5 μm and finally a surface protective layer of gelatin was formed thereon in a thickness of 1 μm. The finished samples corresponded to a color negative photosensitive material. They were designated Film 4A to 4D, respectively, according to the kind of antihalation layer employed.

Each sample was exposed to light for 1/200 second through a Fuji Color Separation Filter Sp-3 (the spectral transmittance curve is shown in the figure) and a continuous gray wedge using a tungsten light source with a color temperature of 5500° K and then the sample was subjected to the following processings.

| Step | Temperature | Time |
|---|---|---|
| 1. Color Development | 37.8° C | 3½ minutes |
| 2. Water Wash | " | 1 minute |
| 3. Bleaching | " | 6 minutes |
| 4. Water Wash | " | 1 minute |
| 5. Fixing | " | 6 minutes |
| 6. Water Wash | " | 1 minute |
| 7. Stabilizing | " | 1 minute |

Each processing solution used had the following composition.

| | |
|---|---|
| Color Developer: | |
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Tetrasodium Ethylenediamine Tetraacetate | 2 g |
| 4-Amino-3-methyl-N-ethyl-N-(β-hydroxyethyl)aniline Sesquisulfate (monohydrate) | 4 g |
| Water to make | 1 liter |
| Bleaching Solution: | |
| Sodium Salt of Ethylenediamine Tetraacetic Acid-Ferric Complex Salt | 100 g |
| Potassium Bromide | 50 g |
| Ammonium Nitrate | 50 g |
| Boric Acid | 5 g |
| Water to make | 1 liter |
| Fixing Solution: | |
| Sodium Thiosulfate | 150 g |
| Sodium Sulfite | 15 g |
| Borax | 12 g |
| Glacial Acetic Acid | 15 ml |
| Potassium Alum | 20 g |
| Water to make | 1 liter |
| Stabilizing Solution: | |
| Boric Acid | 5 g |
| Sodium Citrate | 5 g |
| Sodium Metaborate (tetrahydrate) | 3 g |
| Potassium Alum | 15 g |
| Water to make | 1 liter |

A photographic characteristic curve of the cyan image on each processed sample was obtained and the exposure necessary to obtain fog density +0.1 was determined. The sensitivity was evaluated as a reciprocal of the exposure. The resulting relative value of sensitivity and the degree of stain on each sample were as follows.

| Film No. | Relative Sensitivity of Cyan Image by Red Light Exposure | Stain |
|---|---|---|
| 4A | 73 | None |
| 4B | 90 | None |
| 4C | 91 | None |
| 4D | 100 | None |

In Film 4A wherein Dye E for comparison was used, the sensitivity of the red-sensitive emulsion layer was fairly well reduced as compared with that of the control Film 4D due to a filter effect based on diffusion of the dye into the red-sensitive emulsion layer from the antihalation layer. Films 4B and 4C according to the present invention had nearly the same sensitivity as that of the control Sample 4D.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive element comprising at least one hydrophilic colloid layer which contains poly(2-diethylamino ethylmethacrylate), the poly(2-diethylamino ethymethacrylate) being a water-soluble high molecular weight material which has a basic residue in a main chain thereof or in a branch chain thereof and which is compatible with gelatin, the poly(2-diethylamino ethymethacrylate) being present in an amount of 80 to 800 mg/m² which is effective for mordanting, and at least one oxonal dye represented by the following formula (I):

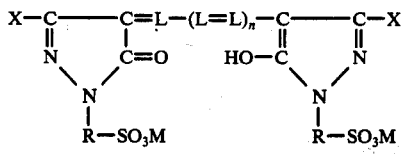

wherein R represents a divalent aliphatic group; M represents a cation; L represents a methine group; *n* represents 0, 1 or 2, and -X represents a residue selected from the group consisting of $—X^1$, $—CH_2X^1$, —CONX¹, NHCOX¹, NHCONHX¹ or NHCSNHX¹, wherein X¹ represents a phenyl group, the at least one oxonol dye being present in an amount effective to photographically color the hydrophilic colloid layer.

2. The silver halide photographic light-sensitive element of claim 1, wherein said divalent aliphatic group for R has 5 or less carbon atoms and said aliphatic group can contain an unsaturated bond, can be interrupted by a hetero atom and can be substituted with one or more of a hydroxyl group, an alkoxy group or a halogen atom.

3. The silver halide photographic light-sensitive element of claim 2, wherein said divalent aliphatic group is an alkylene group, an alkenylene group, an alkyleneoxyalkylene group, an alkylenethioalkylene group or an alkylene group substituted with a hydroxy group or an alkoxy group; M is a hydrogen atom, an alkali metal atom, an alkaline earth metal atom or an organic base cation; and said phenyl group for X¹ can be substituted with one or more of a halogen atom, a cyano group, a sulfo group, a carboxy group, an alkoxycarbonyl group, a carbamoyl group, an alkylcarbamoyl group, an acyl group, an alkyl group, a hydroxy group, an alkoxy group, a phenoxy group, an amino group, an alkylamino group, a dialkylamino group, an acylamino group, an alkylsulfonylamino group, or an alkylcarbonyloxy groups; and the methine group forming the methine chain represented by said $=L—(L=L)_n—$ can be substituted with an alkyl group, a phenyl group, a benzyl group, a phenethyl group or a halogen atom.

4. The silver halide photographic light-sensitive element of claim 1, wherein said divalent aliphatic group for R is an alkylene group or alkenylene group, and X is a phenyl group, a phenylcarbamoyl group or a phenylureido group.

5. The silver halide photographic light-sensitive element of claim 1, wherein said dye is

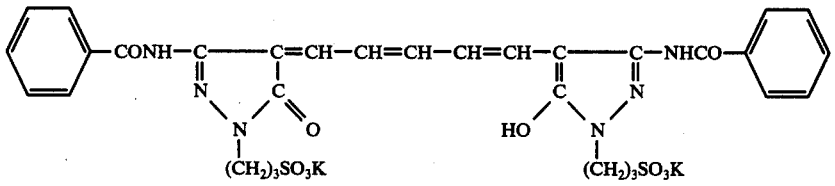

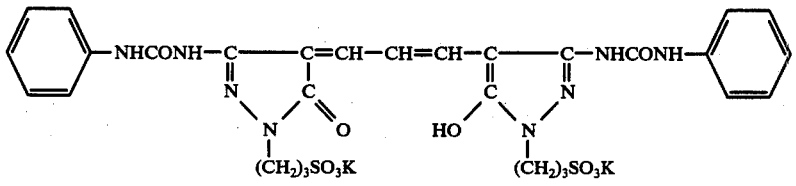

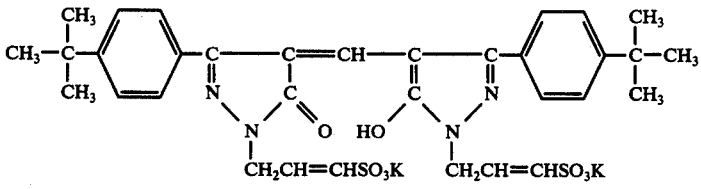

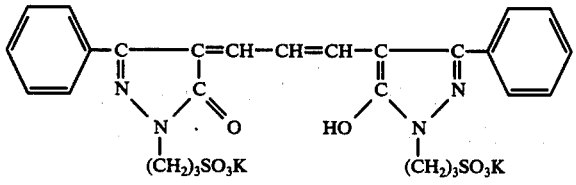

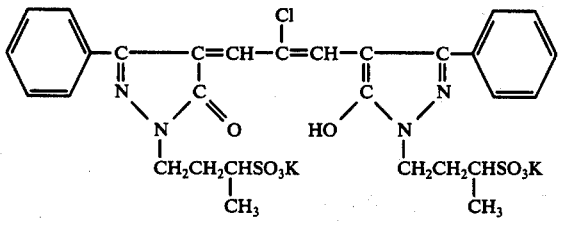

-continued
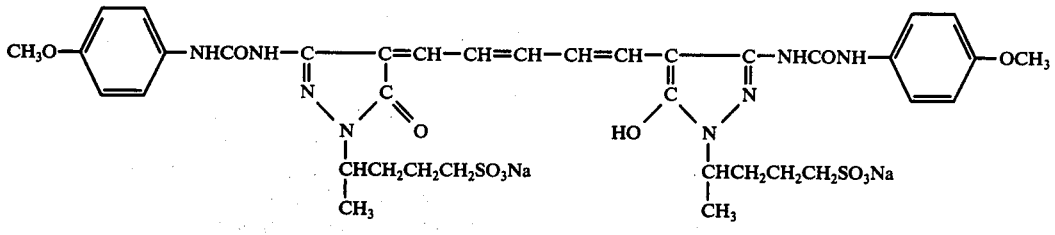
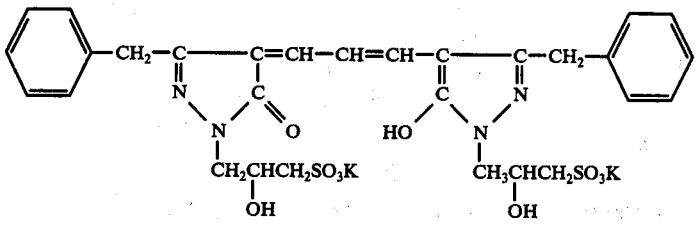
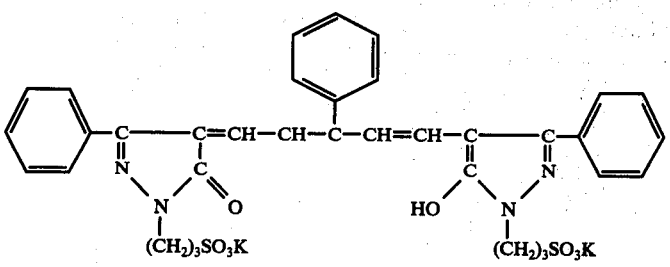
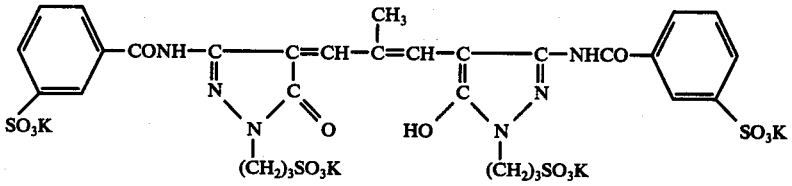
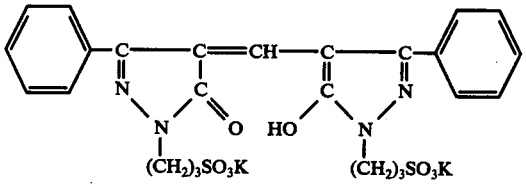
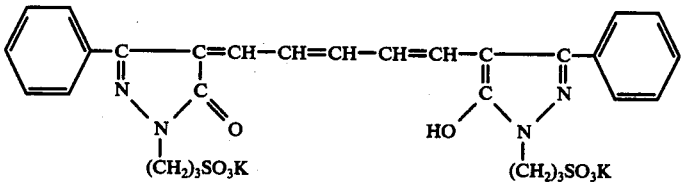
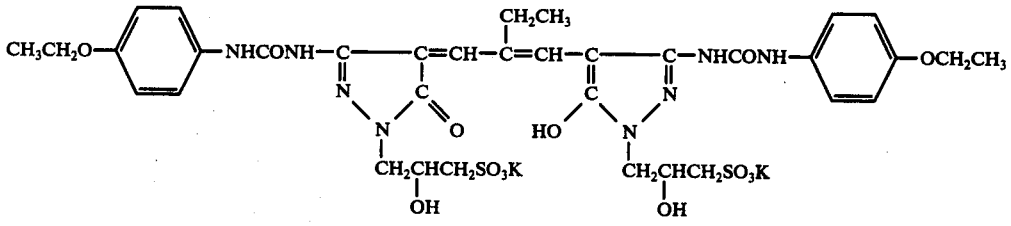

-continued
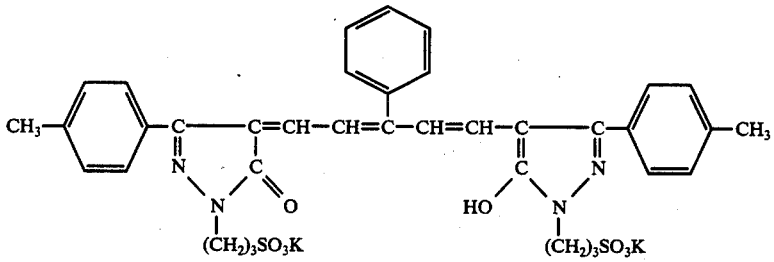
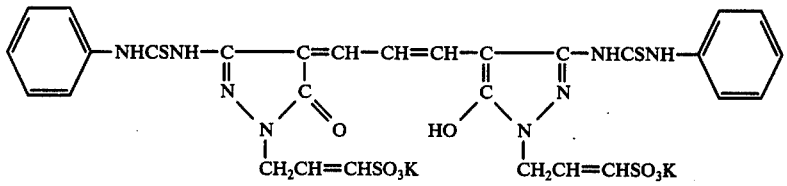
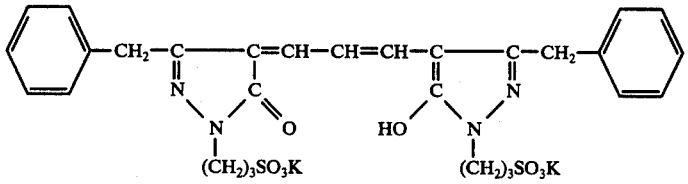
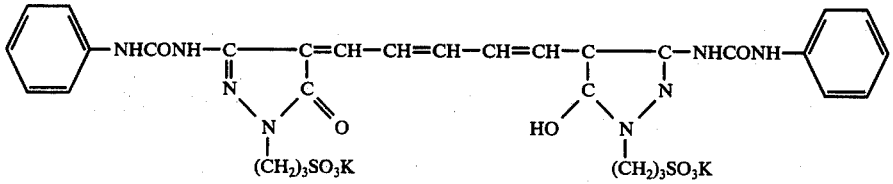
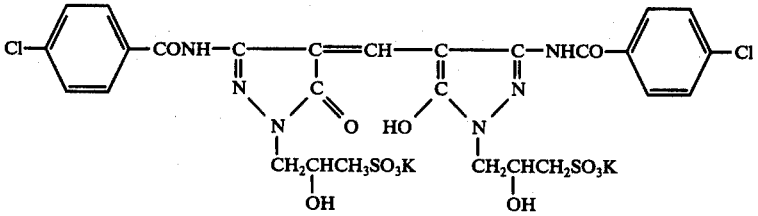
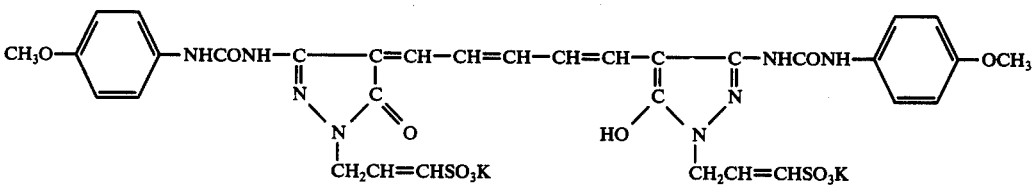
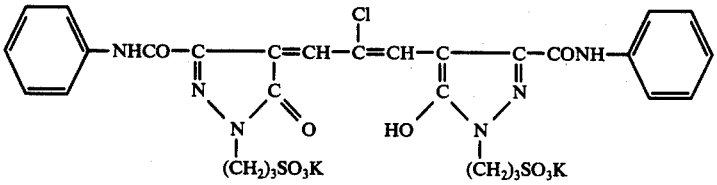
and
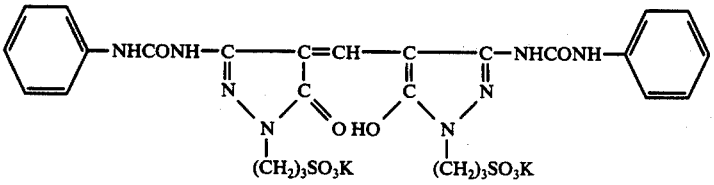

6. The silver halide photographic light-sensitive element of claim 1, wherein said dye is selected from the group consisting of:
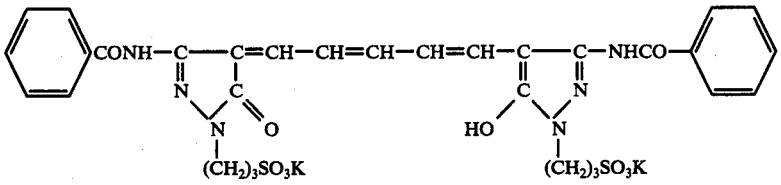
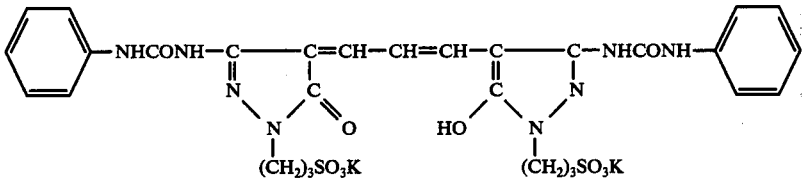
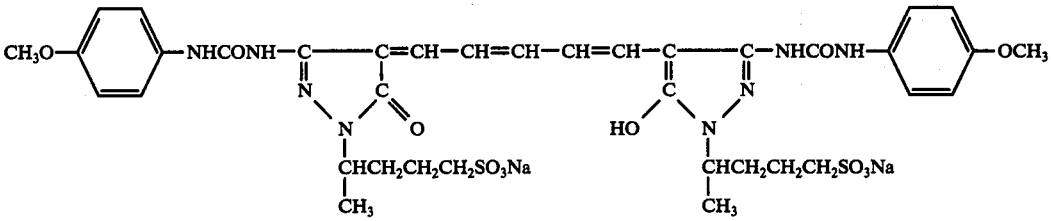
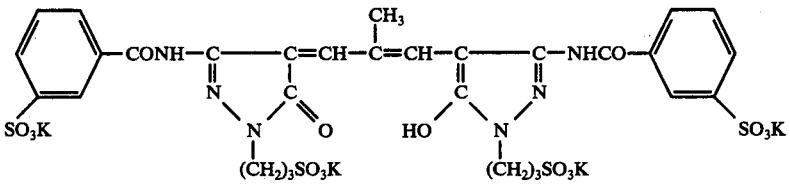
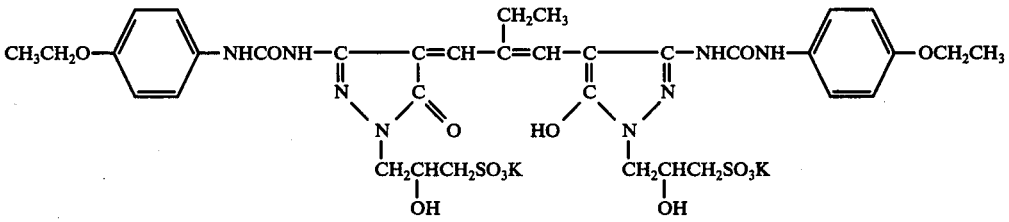
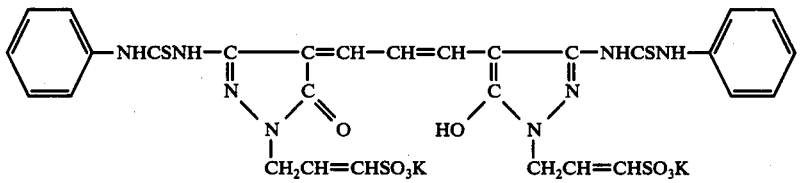
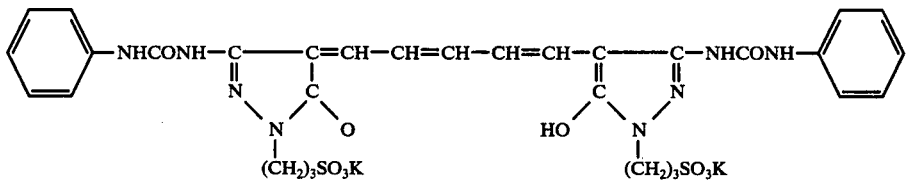

-continued

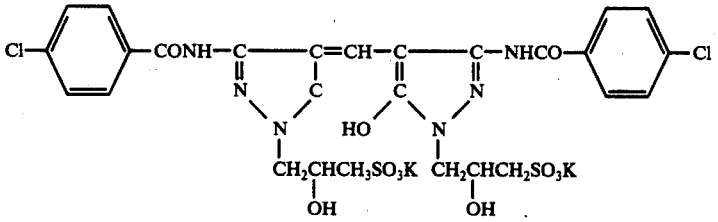

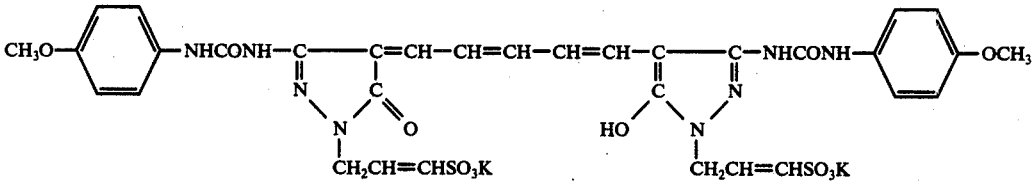

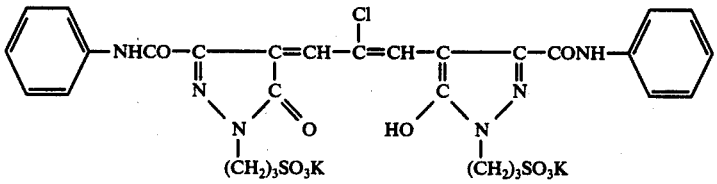

and

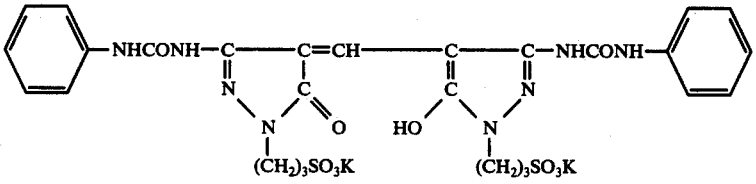

7. The silver halide photographic element of claim 1, wherein the at least one hydrophilic colloid layer which contains the basic polymer and the oxonol dye is a filter layer.

8. The silver halide photographic element of claim 1, wherein the at least one hydrophilic colloid layer whicn contains the basic polymer and the oxonal dye is an antihalation layer.

9. The silver halide photographic element of claim 1, comprising a support having thereon a light-sensitive silver halide photographic emulsion layer and positioned thereabove the at least one hydrophilic colloid layer which contains the basic polymer and the oxonal dye.

10. The silver halide photographic element of claim 1, comprising a support carrying thereon a plurality of light-sensitive photographic silver halide emulsion layers wherein the at least one hydrophilic colloid layer is between emulsion layers.

11. The silver halide photographic element of claim 1, comprising a support carrying thereon a light-sensitive silver halide photographic emulsion layer wherein the at least one hydrophilic colloid layer is between the emulsion layer and the support.

* * * * *